US008657624B2

(12) United States Patent
Yoshida

(10) Patent No.: US 8,657,624 B2
(45) Date of Patent: Feb. 25, 2014

(54) WATERPROOF CONNECTOR

(75) Inventor: Toshikazu Yoshida, Osaka (JP)

(73) Assignee: Yukita Electric Wire Co., Ltd., Osaka (JP)

( * ) Notice: Subject to any disclaimer, the term of this patent is extended or adjusted under 35 U.S.C. 154(b) by 63 days.

(21) Appl. No.: 13/390,898

(22) PCT Filed: Aug. 20, 2009

(86) PCT No.: PCT/JP2009/064589
§ 371 (c)(1),
(2), (4) Date: Feb. 16, 2012

(87) PCT Pub. No.: WO2011/021297
PCT Pub. Date: Feb. 24, 2011

(65) Prior Publication Data
US 2012/0149227 A1 Jun. 14, 2012

(51) Int. Cl.
*H01R 13/62* (2006.01)

(52) U.S. Cl.
USPC ..... 439/578; 439/584

(58) Field of Classification Search
USPC ..... 439/587–589, 584
See application file for complete search history.

(56) References Cited

U.S. PATENT DOCUMENTS 3,581,269 A * 5/1971 Frey et al. ..... 439/584
3,905,672 A * 9/1975 Anhalt et al. ..... 439/281
3,963,320 A * 6/1976 Spinner ..... 439/584
4,531,796 A * 7/1985 Gansert et al. ..... 439/589
5,651,698 A * 7/1997 Locati et al. ..... 439/578
6,331,123 B1 * 12/2001 Rodrigues ..... 439/584
7,422,458 B2 9/2008 Arai
7,588,460 B2 * 9/2009 Malloy et al. ..... 439/578
7,934,956 B1 * 5/2011 Hsia ..... 439/587
7,967,634 B1 * 6/2011 Hsia ..... 439/583
JP 2003-346970 12/2003

(Continued)

FOREIGN PATENT DOCUMENTS

JP 5-34672 U 5/1993
JP 2003-115353 A 4/2003

(Continued)

OTHER PUBLICATIONS

International Search Report for the Application No. PCT/JP2009/064559 mailed Oct. 6, 2009.

*Primary Examiner* — Gary Paumen
(74) *Attorney, Agent, or Firm* — Cheng Law Group, PLLC

(57) ABSTRACT

A waterproof connector configured such that parts constituting the connector can be assembled together in a work site and can be assembled easily. The waterproof connector is provided with a terminal (40) joined by crimping to a conductor (121) of a cable (12), a retaining sleeve (60) mounted so as to extend from the vicinity of the rearward end of the terminal (40) and across an outer casing (122) of the cable (12), a body housing (70) having formed therein a tubular bore (71) for containing the retaining sleeve (60), and a fastening nut (90) mounted on the rearward end side of the body housing (70). When a substantially half of the forward end side of the retaining sleeve (60) is inserted into the tubular bore (71) in the body housing (70) and the fastening nut (90) is engaged with a male thread portion (76) formed on the exterior of the tubular bore (71), an end of the retaining sleeve (60) is reduced in diameter by being pressed by constricting tapered portions (75, 92), and as a result, the terminal (40) and the outer casing (122) of the cable (12) are held watertight.

11 Claims, 22 Drawing Sheets

(56) References Cited

U.S. PATENT DOCUMENTS

| | | | | |
|---|---|---|---|---|
| 7,993,159 | B2 * | 8/2011 | Chawgo | 439/584 |
| 8,177,583 | B2 * | 5/2012 | Chawgo et al. | 439/584 |
| 2004/0038588 | A1 * | 2/2004 | Bernardi et al. | 439/587 |
| 2006/0166554 | A1 * | 7/2006 | Hung | 439/589 |
| 2008/0119078 | A1 | 5/2008 | Arai | |
| 2010/0099298 | A1 * | 4/2010 | Montena et al. | 439/584 |

FOREIGN PATENT DOCUMENTS

| | | | |
|---|---|---|---|
| JP | 2004-158427 | A | 6/2004 |
| JP | 2008-130462 | A | 6/2008 |
| JP | 2008-311196 | A | 12/2008 |

* cited by examiner

WATERPROOF CONNECTOR

TECHNICAL FIELD

The present invention relates to a waterproof connector that can be used for providing through-connections for outdoor cabling, etc., especially for the electric power cables of solar battery modules.

BACKGROUND ART

In Patent Documents 1-3, the present applicants proposed a mono-axial waterproof connector used mainly for providing through-connections for outdoor cabling and the like. FIGS. 19-22 show the construction of the waterproof connector 1 described in Patent Document 1. This waterproof connector 1 is adapted for use as a connector in situations where the cables 12, 13 are cut to the desired length and components are attached to their terminals at a work location.

The illustrated waterproof connector 1 is configured either as a plug 2 that has a male terminal 21, or as a receptacle 3 that has a female terminal 31. When two connectors are interengaged, two terminals become electrically connected. On the outside, the plug 2 and receptacle 3 are substantially cylindrical in shape and are attached to the terminals of the cables 12, 13 in line with their respective axial centers. The cross-sectional structures of the plug 2 and receptacle 3 are generally similar except for the peripheral portions of the terminals 21, 31. Namely, the plug 2 and receptacle 3 are respectively equipped with terminal mold portions 22, 32, which cover a male terminal 21 or a female terminal 31; substantially cylindrical watertight sleeves 26, 36, which cover a range extending from the terminal mold portions 22, 32 to the outer casings 122, 132 of the cables 12, 13, and fastening members 27, 37, which cover substantially the entire length of the watertight sleeves 26, 36 and are interfitted or threadably engaged with the terminal mold portions 22, 32.

The terminal mold portions 22, 32 are formed integrally using the so-called insert molding (over-molding) technique, in which a tubular female terminal 31 or a rod-like male terminal 21 made up of an electrically conductive metal is placed in a mold and subjected to injection molding using a synthetic rubber-type material. The terminal mold portions 22, 32 are formed such that the distal end portions 23, 33, which cover the terminals 21, 31, are made thinner, and the diameter widens from the central portion towards the forward end portion. The rearward end portions of the terminals 21, 31 pass through the distal end portions 23, 33 of the terminal mold portions 22, 32 and are slightly exposed at the rearward end of the terminal mold portions 22, 32. The conductors 121, 131 exposed by removing the outer casings 122, 132 of the cables 12, 13 are inserted into the exposed portions and secured by crimping.

It should be noted that when the construction of the waterproof connector 1 is described in the present specification, the side of the plug 2 and receptacle 3 used for engagement with its counterpart is referred to as the "forward end", whereas the opposite side (the side connected to the cables 12, 13) is referred to as the "rearward end".

The forward end portion of the terminal mold portions 22, 32 extends forward to surround the terminals 21, 31, forming a mating recess portion 221 (provided in the plug 2) and a mating projection portion 321 (provided in the receptacle 3) that are mutually interfittable. Ridge members 222, 322 with sawtooth cross-sections are formed on the mating faces of the mating recess portion 221 and mating projection portion 321 in order to increase the strength of mutual interfitment and water-tightness.

The watertight sleeves 26, 36, which are made up of a synthetic rubber-type material of superior elasticity, are mounted from the outer casings 122, 132 of the cables 12, 13 all the way to the distal end portions 23, 33 of the terminal mold portions 22, 32. The inner circumferential surface of the rearward end of the watertight sleeves 26, 36, which is formed to have an undulating cross-section, surrounds the outer casings 122, 132 of the cable 12 in a watertight manner. In addition, mounting grooves 262, 362 are formed in the inner circumferential surface of the forward end of the watertight sleeves 26, 36. These mounting grooves 262, 362 are interfitted with the mounting step portions 231, 331 formed on the outer circumferential surface of the distal end portions 23, 33 of the terminal mold portions 22, 32, thereby ensuring the water-tightness of the interface. The watertight sleeves 26, 3626 are formed such that their wall thickness increases and their outside diameter expands from the rearward end towards the forward end.

The fastening members 27, 37 are formed from a synthetic resin-based material of a rigidity that is higher than that of the synthetic rubber-based material used to form the watertight sleeves 26, 36. The fastening members 27, 37 are mounted throughout the entire length of the watertight sleeves 26, 36 and substantially half of the rearward end of the terminal mold portions 22, 32, thereby protecting the same. Threadably interengaged tapered threaded portions 251, 252, 351, and 352 are provided on the inner circumferential surface of the fastening members 27, 37 and on the outer circumferential surface of the terminal mold portions 22, 32, with the threaded engagement surface sealed in a watertight manner by tightening the fastening members 27, 37. In addition, the inner circumferential surface of the fastening members 27, 37 is formed to have a diameter that becomes narrower from the forward end to the rearward end, with this inner circumferential surface clamping the outer circumferential surface of the watertight sleeves 26, 36 with sufficient force.

Furthermore, locking projection portions 241, 341 are formed in the forward end portion of the fastening members 27, 37. When the fastening members 27, 37 are threadably engaged, these locking projection portions 241, 341 are engaged with the locking recess portions 242, 342 formed on the outer circumferential surface of the terminal mold portions 22, 32, thereby preventing the engagement from being easily loosened.

In this way, along with reliably maintaining intimate contact at the interface of the watertight sleeves 26, 36 and terminal mold portions 22, 32 as well as at the interface of the watertight sleeves 26, 36 and outer casings 122, 132 of the cables, the fastening members 27, 37 maintain a sufficient clamping force based on the rigidity of the fastening members 27, 37 themselves and resist external forces such as impact or bending stresses. In such a configuration, stable waterproofing performance can be obtained over an extended period of time.

FIG. 23 illustrates a waterproof connector 1 disclosed as another embodiment in Patent Document 1. In this waterproof connector 1, fastening members 27, 37 provided in the plug 2 and receptacle 3 are respectively provided with pawl portions 4 and a pawl-receiving portion 5. The pawl portions 4 extend from the fastening member 37 provided in the receptacle 3 towards the terminal mold portion 32 and are formed to be resiliently deformable. In addition, the pawl-receiving portion 5, which receives the pawl portions 4, is formed on the exterior of the fastening member 27 provided in the plug 2.

When the plug 2 is interfitted with the receptacle 3, these pawl portions 4 and pawl-receiving portion 5 are interengaged and resist separation of the plug 2 from the receptacle 3. As a result, a stable joined state and waterproofing performance can be ensured for an extended period of time.

In addition, Patent Document 4 discloses a configuration wherein, in a connector made up of a plug and a socket (receptacle) as described above, locking protuberances protruding from one side (corresponding to the pawl portions 4 in the waterproof connector 1 of FIG. 23) are engaged with an engagement portion on the other side (corresponding to the pawl-receiving portion 5 in the same figure). This engagement portion is provided with a skirt portion covering the forward end portion of the locking protuberances inserted into the engagement portion. This skirt portion prevents the engaged locking protuberances from disengagement due to inadvertent fingertip manipulation or to the action of external forces and is designed to prevent disengagement unless special tools are used. However, the above-mentioned document does not specifically describe the internal structure of the connector and does not clarify the terminal molding and assembly methods used.

PRIOR ART DOCUMENT

Patent Document

[Patent Document 1] JP2004-158427A
[Patent Document 2] JP2003-115353A
[Patent Document 3] JP2003-346970A
Patent Document 4] JP2008-311196A

SUMMARY OF INVENTION

Problems to be Solved by the Invention

Among the conventional waterproof connectors disclosed in the above-described patent documents, the connectors disclosed in Patent Documents 2 and 3 are formed by overmolding terminals with synthetic resin. The connector disclosed in Patent Document 4 is assumed to be obtained by a similar molding method. Although such molded articles can provide uniform molding accuracy, such articles cannot be used in embodiments involving cutting a cable to an arbitrary length and attaching connectors to its terminals at a work location.

The waterproof connector disclosed in Patent Document 1 is molded such that the terminal mold portions 22, 32, watertight sleeves 26, 36, and fastening members 27, 37 are separate components. The operation of mounting the watertight sleeves 26, 36 on the terminal mold portions 22, 32 and threadably engaging the fastening members 27, 37 can then be performed at a work location without using special devices. Therefore, the operation of assembly of a waterproof connector 1 by cutting cables 12, 13 to the necessary length and bonding the terminal mold portions 22, 32 to the terminals by crimping can be performed at a work location as well, thereby increasing convenience in the way work is done.

However, even in the above-described construction, the terminal mold portions 22, 32 obtained by coating the terminals 21, 31 with a synthetic rubber-based material have to be prepared in advance using insertion molding, etc. This causes the cost of component procurement to increase, which leaves room for improvement in this respect.

Accordingly, the present invention provides a waterproof connector that does not require the step of terminal in-mold coating using insertion molding and the like and is made up of components that can all be assembled at a work location, including the portions surrounding the terminals. Quite naturally, an increase in the strength of component assembly and water-tightness is a natural practical requirement in conjunction with this task.

Furthermore, work locations where this type of waterproof connector is used include, for example, roof surfaces, on which a large number of solar battery modules are installed. In such locations, it is preferable to make operation more convenient and simple by reducing the number of components and steps in the operating procedure as much as possible with a view to prevent components and tools from being accidentally dropped, etc. Accordingly, as a more specific task, the present invention provides a waterproof connector whose construction makes it possible for a cable with components pre-assembled in advance at the ends thereof to be brought to a work location, subjected to adjustment and wiring checkup operations at the work location, if necessary, and then undergo permanent component assembly operations in order to completely secure and waterproof the components.

Means for Solving the Problems

In order to achieve the above-mentioned object, the waterproof connector of the present invention is designed as a waterproof connector provided with a terminal, a retaining sleeve, a main body housing, and a fastening nut, wherein the terminal has an elongate rod-like or tubular shape and its rearward end is compression bonded to a conductor of a cable; the retaining sleeve is mounted in the vicinity of the rearward end of the terminal and across the outer casing of the cable, on the outside thereof, the main body housing has a tubular bore receiving the retaining sleeve and substantially half of the forward end of the retaining sleeve is inserted through the rearward end of the main body housing into the tubular bore; a male threaded portion is formed on the exterior of the tubular bore in the main body housing; the fastening nut has a female threaded portion formed on the inside thereof and is mounted onto the main body housing from the rearward end of the main body housing while the female threaded portion is threadably engaged with the male threaded portion; and clamping means for subjecting a portion of the retaining sleeve received between the main body housing and the fastening nut to deformation in a diameter-reducing direction is provided on the inside of the fastening nut and the tubular bore of the main body housing.

This arrangement is a waterproof mono-axial connector provided at the end of a cable, either as a plug having a male terminal or as a receptacle having a female terminal, which comprises: a terminal of an elongate rod-like or tubular shape having its rearward end compression bonded to a conductor of the cable; a retaining sleeve mounted in the vicinity of the rearward end of the terminal and across the outer casing of the cable, on the outside thereof; a main body housing having formed therein a tubular bore that receives the retaining sleeve; a fastening nut mounted at the rearward end of the main body housing, and in which substantially half of the forward end of the retaining sleeve is inserted through the rearward end of the main body housing into the tubular bore formed in the main body housing; the fastening nut is threadably engaged with the male threaded portion formed on the exterior of the tubular bore from the rearward end of the main body housing; and the portion of the retaining sleeve received between the main body housing and the fastening nut is subjected to deformation in a diameter-reducing direction by tightening the fastening nut, thereby gripping the terminal and the outer casing of the cable in a watertight manner.

Such a component arrangement allows for components to be assembled to the terminal at a work location without having to perform molding in advance and, moreover, makes it possible to ensure appropriate water-tightness around the terminal.

In the above-mentioned arrangement, the retaining sleeve comprises a tubular forward end portion surrounding the vicinity of the rearward end of the terminal, a tubular rearward end portion surrounding the outer casing of the cable, and a tubular intermediate portion linking the above; the tubular forward end portion and the tubular rearward end portion are rendered deformable in a diameter-reducing direction by forming axial score lines in multiple locations thereon, and constricting tapered portions clamping the retaining sleeve are formed at respective locations of the fastening nut and the tubular bore of the main body housing that come in contact with the retaining sleeve.

In accordance with this arrangement, when the fastening nut is fastened, the forward and rearward ends of the retaining sleeve are subjected to pressure by the constricting tapered portions formed, respectively, in the main body housing and in the fastening nut, as a result of which they are uniformly clamped in the circumferential direction and reduced in diameter by the narrowing of the score lines formed in each tubular section. Consequently, the tubular forward end portion and the tubular rearward end portion of the retaining sleeve is adhered to the terminal and the outer casing of the cable with high accuracy. In other words, these constricting tapered portions constitute clamping means in the above-mentioned arrangement.

Furthermore, in the present invention, the retaining sleeve is formed such that hook-shaped portions protruding towards the axial center are formed in the tubular forward end portion of the retaining sleeve and the terminal bonded to the cable is inserted, with its forward end first, into the rearward end of the retaining sleeve; and detent projection portions which, during insertion into the retaining sleeve, spread the hook-shaped portions apart and engage with the forward end face of the hook-shaped portions, thereby resisting removal from inside the retaining sleeve, and positioning projection portions, which come in contact with the rearward end face of the hook-shaped portions, are formed in the vicinity of the rearward end of the terminal.

This arrangement allows for the terminal inserted into the retaining sleeve to be held at a predetermined insertion depth inside the retaining sleeve and allows for assembly operations with other components to be performed while carrying out various adjustments and wiring checkup operations without being concerned about dropping or losing, etc., the retaining sleeve and the terminal at a work location by pre-assembling the retaining sleeve to the terminal.

Furthermore, in the present invention, the terminal is formed by rolling up electrically conductive sheet metal material into a cylindrical shape and at least either the detent projection portions or the positioning projection portions are formed by punching the sheet material in a squared C-shape (squared U-shape) and bending the punched portions by a small slant angle.

This arrangement allows for the detent projection portions and positioning projection portions to be formed at low cost. Adjusting the slant angle of the punched portions allows for appropriately regulating the resistance of the detent projection portions in the direction of terminal removal.

Furthermore, in the present invention, the score lines formed in the tubular forward end portion or tubular rearward end portion of the retaining sleeve are formed such that the retaining sleeve is partitioned at an angle to the radial direction passing through the axial center of the retaining sleeve.

This arrangement makes it possible to ensure a considerable amount of flexural deformation by the partitioned portions by avoiding interference between the adjacent partitioned portions on the two sides of the score lines when the retaining sleeve is deformed in a diameter-reducing direction.

Furthermore, in the present invention, a tubular sleeve gasket made up of an elastic polymeric material is interposed between the tubular rearward end portion of the retaining sleeve and the outer casing of the cable.

When the diameter of the tubular rearward end portion of the retaining sleeve becomes narrower, this sleeve gasket it clamped, thereby further improving water-tightness between the retaining sleeve and the outer casing of the cable. It should be noted that, as used herein, the term "elastic polymeric material" refers to various kinds of synthetic rubber and to polymeric compounds (elastomers) exhibiting elasticity on par with synthetic rubber.

Furthermore, in the present invention, an annular O-ring made up of an elastic polymeric material is mounted around the outer periphery of the tubular intermediate portion of the retaining sleeve and this O-ring is press fitted into the tubular bore by inserting the retaining sleeve into the tubular bore of the main body housing.

When the retaining sleeve is inserted into the tubular bore of the main body housing, the O-ring mounted on the tubular intermediate portion of the retaining sleeve is press-fitted into the tubular bore and deformed, thereby watertightly sealing the gap between the main body housing and the retaining sleeve. It should be noted that, as used herein, the term "elastic polymeric material" also refers to various kinds of synthetic rubber and to polymeric compounds (elastomers) exhibiting elasticity on par with synthetic rubber. However, the material of the O-ring does not have to be identical to the material of the sleeve gasket, and a material of a slightly higher rigidity than the sleeve gasket would be preferable from a practical standpoint.

Furthermore, in the present invention, a convergent tapered portion that provisionally retains the O-ring mounted on the retaining sleeve in a state free from compressive deformation is formed at the edge or in the vicinity of the aperture at the rearward end of the tubular bore provided in the main body housing.

The convergent tapered portion in this arrangement is formed such that it maintains the retaining sleeve in a pre-assembled state before it is completely inserted into the tubular bore of the main body housing. The pre-assembled state is a state, in which the retaining sleeve is inserted until the O-ring mounted on the retaining sleeve comes in contact with the convergent tapered portion. A convenient pre-assembled state that prevents components from being scattered or lost is obtained if the fastening nut is lightly threadably engaged with the main body housing in this pre-assembled state. If the fastening nut is strongly tightened against the repulsion force of the O-ring after performing the required adjustment and checkup operations at a work location, the O-ring is press fitted into the tubular bore of the main body housing and a watertight permanent assembled state is obtained.

Furthermore, in the present invention, a hexahedral portion of equilateral hexagonal cross-sectional shape normal to the axial direction is formed in the main body housing and the fastening nut.

In accordance with this arrangement, when the fastening nut is tightened strongly onto the main body housing, the main housing and the fastening nut can be held using a wrench, which improves work efficiency.

Furthermore, in the present invention, a tubular engagement portion that opens at the forward end of the main body housing and passes through the main body housing in the axial direction is provided in the forward end portion of the main body housing, and a pair of guard ribs rising to a height of 3 mm or more in a direction normal to the direction of passage of the engagement portion are formed at the edge of the rearward end of the engagement portion and at a location retracted 4-9 mm from the edge portion at the rearward end in the axial direction of the main body housing.

A counterpart waterproof connector interconnected with the waterproof connector, or locking protuberances provided on an appropriate connecting member corresponding thereto are inserted, with their forward ends first, into the engagement portion according to this arrangement and locking pawls formed at the forward ends of the locking protuberances are elastically engaged with the rearward end of the engagement portion.

A pair of guard ribs rising in an opposed configuration in a direction normal to the direction of passage of the engagement portion are formed in this arrangement in order to prevent the locking protuberances from being deformed by inadvertent fingertip manipulations or by the action of external forces and prevent the removal of the locking pawls from the engagement portion in this engaged state. The two guard ribs are formed with a gap of 4-9 mm and a height of 3 mm or more, thereby preventing entry of a fingertip therebetween. In comparison with the conventional arrangement disclosed in Patent Document 4, in which the engagement portion is provided with a skirt, this type of arrangement facilitates removal from the mold during molding.

Effects of the Invention

In the inventive waterproof connector, which is made up of a terminal formed as a separate component, a retaining sleeve, a main body housing, and a fastening nut, the retaining sleeve is mounted on the terminal compression bonded to a conductor of a cable, substantially half of the forward end of the retaining sleeve is inserted through the rearward end of the main body housing into a tubular bore formed in the main body housing, and the fastening nut is threadably engaged with a male threaded portion formed on the exterior of the tubular bore from the rearward end of the main body housing, as a result of which the connector is adapted to receive the retaining sleeve between the main body housing and the fastening nut, thereby making it possible to assemble all the components surrounding the terminal at a work location without having to perform in-mold coating of the terminal using insertion molding and the like.

In addition, tightening the fastening nut threadably engaged with the main body housing causes a portion of the retaining sleeve to be subjected to deformation in a diameter-reducing direction, with the terminal and the outer casing of the cable held in a watertight manner, as a result of which the entry of water into the space around the terminal can be prevented in a reliable manner a using simple assembly operation.

Furthermore, configuring the waterproof connector of the present invention such that detent projection portions and positioning projection portions are formed on the terminal and the terminal is pre-assembled in a state of being inserted into the retaining sleeve facilitates assembly operations with other components while performing various adjustments and wiring checkup operations without being concerned about dropping or losing, etc., the retaining sleeve and terminal at a work location.

These effects reduce the cost of component procurement while markedly improving the ease of use and work efficiency.

DESCRIPTION OF EMBODIMENTS

Figure 1:
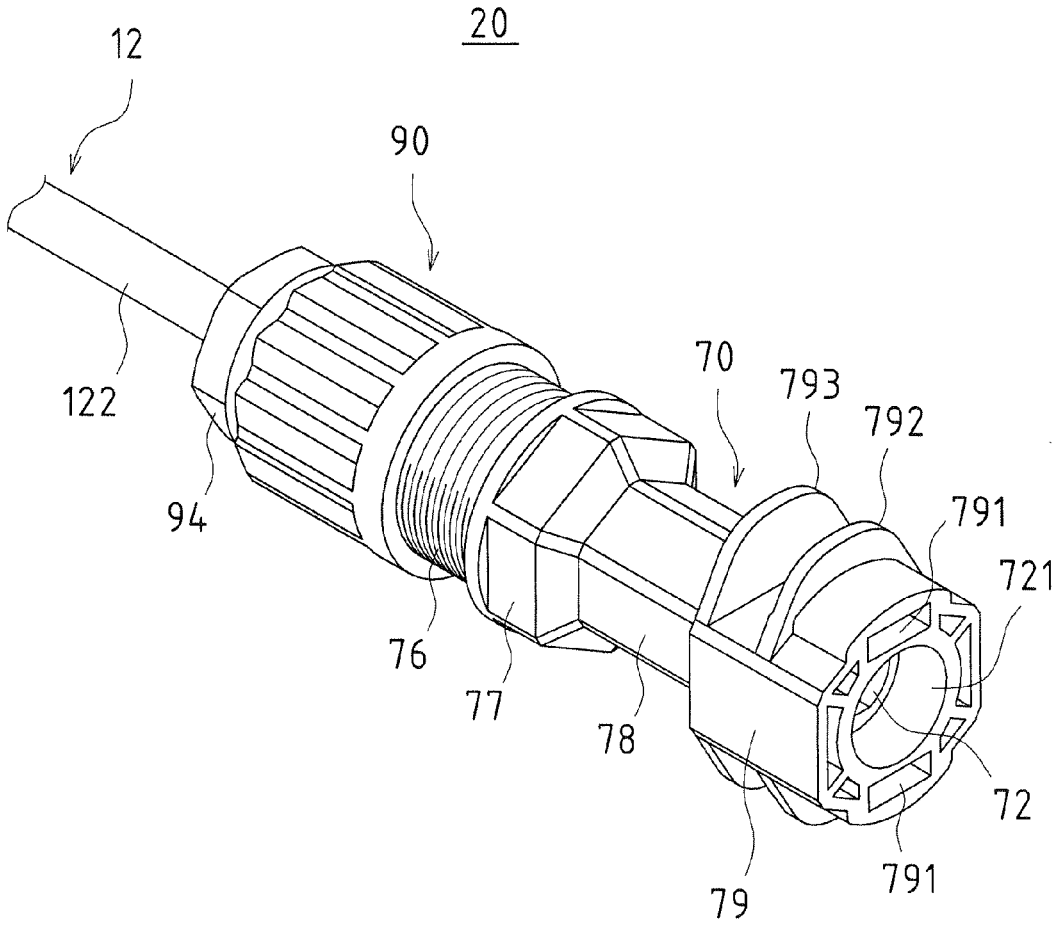
FIG. 1 An oblique view illustrating the overall shape of the plug according to Embodiment 1 of the inventive waterproof connector.
Figure 2:
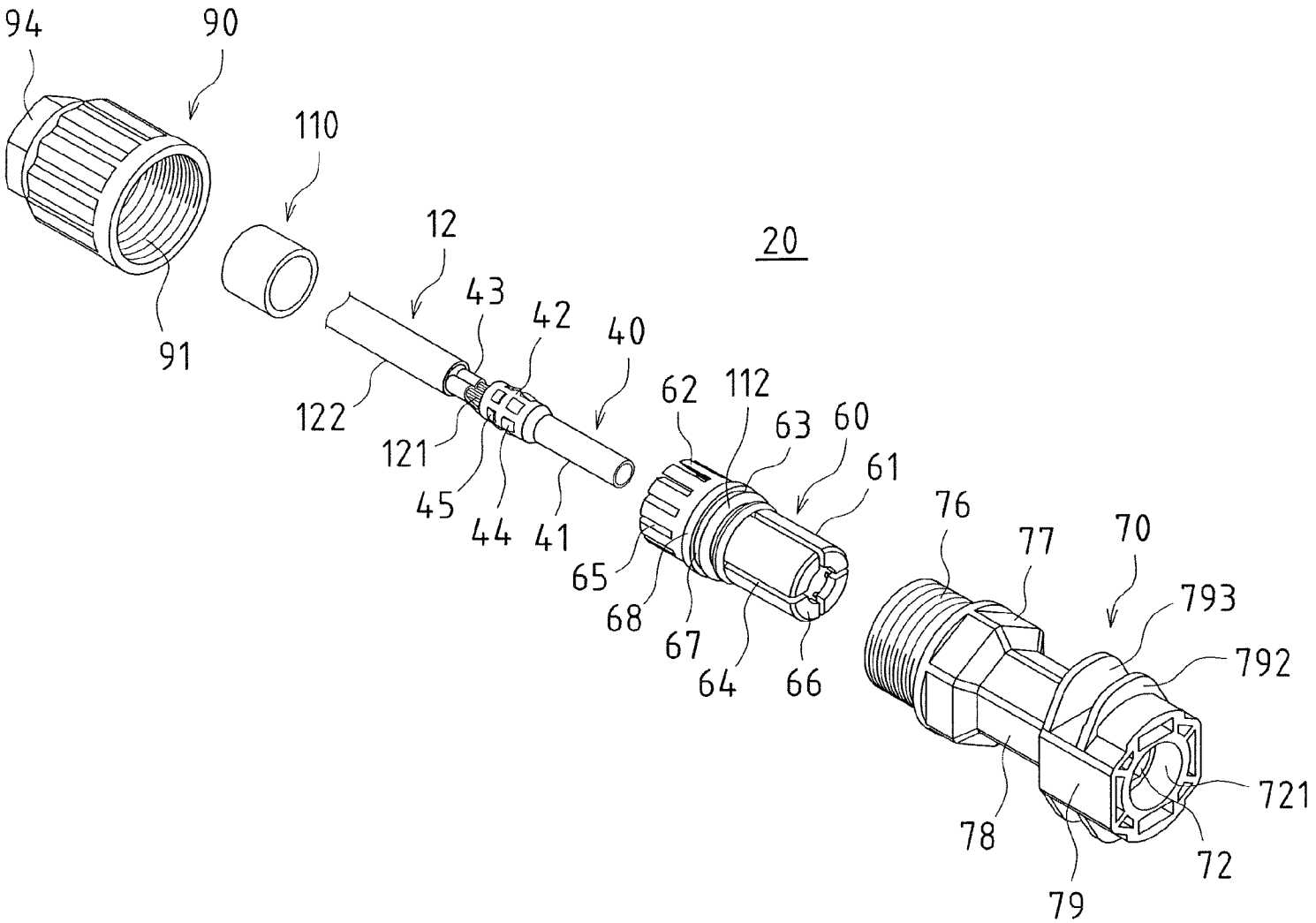
FIG. 2 An exploded oblique view illustrating the arrangement of components in the plug.

Specific embodiments of the present invention are described below. The inventive waterproof connector is implemented as a plug equipped with a male terminal or a receptacle equipped with a female terminal. In the plug and receptacle, the two terminals are electrically connected by interfitting the receptacle or plug with its counterpart. Although the plug and receptacle are usually used as a pair, it is of course possible to use either the plug or the receptacle alone in conjunction with other cabling connection tools matching the shape of the terminals.

FIG. 1-FIG. 6 show an example (Embodiment 1), in which the inventive waterproof connector is reduced to practice in the form of a plug 20. In addition, FIG. 7-FIG. 12 illustrate an example (Embodiment 2), in which the inventive waterproof connector is reduced to practice as a receptacle 30. FIG. 13 illustrates a state, in which the plug 20 and receptacle 30 are interfitted with each other.

On the outside, the plug 20 and receptacle 30 are substantially cylindrical in shape and are attached to the terminals of the cables 12, 13 or to the two terminals of a single length of cable in line with respective axial centers of the cables. Monoaxial cables obtained by covering conductors (twisted wires) 121, 131 with outer casings 122, 132 made of PVC are used as the cables 12, 13. With the exception of the portions surrounding the terminals, the internal construction and component arrangement of the plug 20 and receptacle 30 are generally standard, thereby reducing the cost of component procurement.

It should be noted that in the description that follows, the side of the plug 20 and receptacle 30 used for engagement with its counterpart is referred to as the "forward end", whereas the opposite side (the side connected to the cables 12, 13) is referred to as the "rearward end".

<Plug>

First of all, the configuration of the plug 20 will be described in detail with reference to FIG. 1-FIG. 5. The plug 20 is formed by assembling six components including a male terminal 40 attached to a cable 12, a retaining sleeve 60 of a substantially cylindrical shape mounted on the exterior of the cable 12 and male terminal 40, a sleeve gasket 110 interposed between the cable 12 and retaining sleeve 60, an O-ring 112 fitted over the outer peripheral surface of the retaining sleeve 60, a plug-side main body housing 70 receiving the retaining sleeve 60, and a fastening nut 90 mounted on the rearward end of the plug-side main body housing 70.

The male terminal 40 is formed by rolling electrically conductive sheet metal material into an elongated cylindrical configuration. Substantially half of the forward end of the male terminal 40 is a small-diameter portion 41 inserted into the female terminal 50 of the hereinafter described receptacle 30, and a base 42 of a diameter larger than that of the small-diameter portion 41 is formed in the intermediate portion. A crimp-joint portion 43 with a substantially U-shaped cross-section is provided in the rearward end portion of the terminal. The male terminal 40 is bonded to the conductor 121 of the cable 12 by deforming this crimp-joint portion 43 and crimping it to the conductor 121 of the cable 12. The operation of bonding the terminal to the conductor 121 of the cable 12 can be performed at a work location using regular crimping tools, etc.

Several projection portions are formed in the circumferential direction of the base 42 of the male terminal 40 by punching sheet material in a squared C-shape (squared U-shape) and bending the punched portions up by a small slant angle. The projection portions formed at the forward end of the male terminal 40 serve as detent projection portions 44, which are formed such that their diameter expands from the forward end towards the rearward end of the male terminal 40 and which resist removal from inside the retaining sleeve 60 when the terminal is inserted into the hereinafter described retaining sleeve 60. The projection portions formed at the rearward end of the male terminal 40 also serve as positioning projection portions 45, which are formed such that their diameter expands from the rearward end towards the forward end of the male terminal 40 and which control the depth of insertion of the male terminal 40 when it is inserted into the hereinafter described retaining sleeve 60. Predetermined gaps corresponding to the thickness of the hereinafter described hook-shaped portions 66 formed in the retaining sleeve 60 are provided between the detent projection portions 44 and positioning projection portions 45.

The retaining sleeve 60 is mounted throughout a range extending from the vicinity of the base 42 of the male terminal 40 and across the outer casing 122 of the cable 12, on the outside thereof. FIGS. 14-18 show exploded views of selected portions of the retaining sleeve 60. The retaining sleeve 60 has a tubular forward end portion 61, which surrounds substantially half of the rearward end of the male terminal 40, a tubular rearward end portion 62, which surrounds the outer casing 122 of the cable 12, and a tubular intermediate portion 63, which interconnects them. The inside diameter of the tubular forward end portion 61 and the tubular intermediate portion 63 are slightly larger than the outside diameter of the outer casing 122 of the cable 12.

Figure 17:
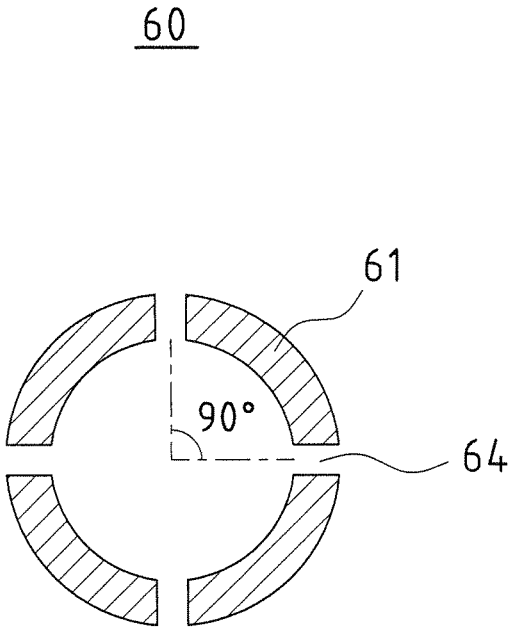
FIG. 17 A cutaway end view of the retaining sleeve taken along line A-A in FIG. 16.

The tubular forward end portion 61 is partitioned by four narrow score lines 64 extending in the axial direction. As shown in FIG. 17, the four score lines 64 are formed such that the central angles located about the axial center of the retaining sleeve 60 are each equal to 90 degrees. As a result of elastic deformation of the tubular forward end portion 61 partitioned by the score lines 64, during which the side connected to the tubular intermediate portion 63 serves as a base, the diameter of the forward end of the tubular forward end portion 61 can be expanded and shrunk in a radial direction. Furthermore, hook-shaped portions that protrude towards the axial center 66 are formed at the forward end of the tubular forward end portion 61. An aperture, whose diameter matches the outside diameter of the base 42 of the above-mentioned male terminal 40, opens in the axial central portion surrounded by the hook-shaped portions 66. In addition, the peripheral edges at the forward end of the tubular forward end portion 61 are slightly chamfered.

The diameter of the outer circumferential surface of the portion interconnecting the tubular forward end portion 61 and the tubular intermediate portion 63 expands in a tapered configuration from the tubular forward end portion 61 towards the tubular intermediate portion 63. A recessed groove 67 is formed in the circumferential direction on the outer circumferential surface of the tubular intermediate portion 63. An O-ring 112 made up of a polymeric material of appropriate elasticity is press-fitted into this recessed groove 67. A large-diameter step portion 68 of a fixed width is formed on the outer circumferential surface in the vicinity of the boundary between the tubular rearward end portion 62 and the tubular intermediate portion 63.

Figure 18:
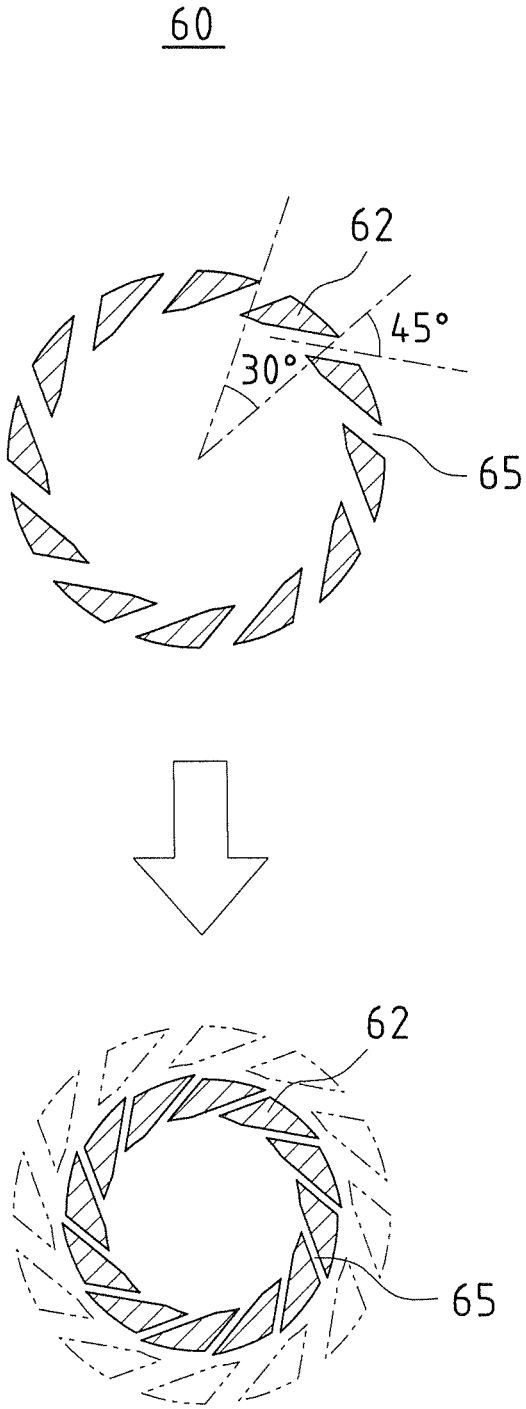
FIG. 18 A cutaway end view of the retaining sleeve taken along line B-B in FIG. 16.
Figure 19:
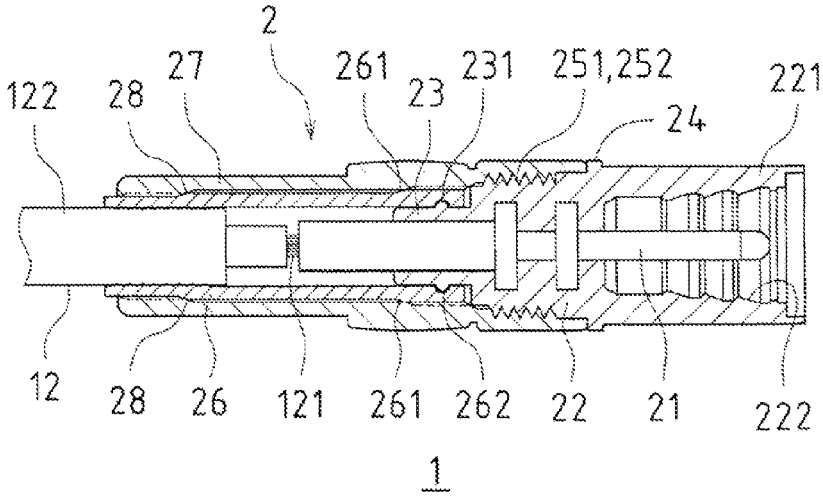
FIG.19 PRIOR ART
FIG. 19 An axial cross-sectional view illustrating the internal construction of the plug according to an embodiment of the conventional waterproof connector.
Figure 20:
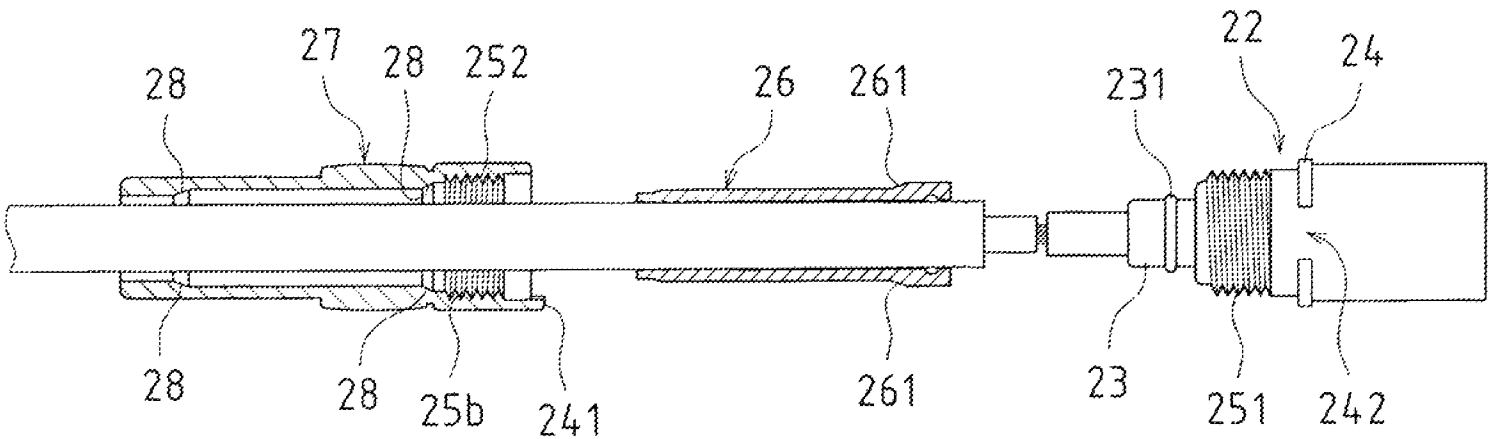
PRIOR ART FIG.20
FIG. 20 A partial cross-sectional/side view illustrating the arrangement of components and assembly of the plug shown in FIG. 19.
Figure 21:
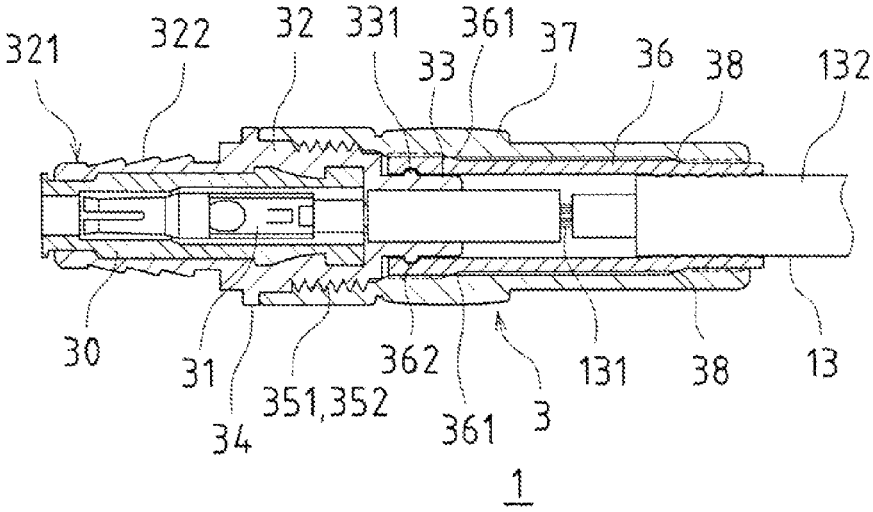
FIG.21 PRIOR ART
FIG. 21 An axial cross-sectional view illustrating the internal construction of the receptacle according to an embodiment of the conventional waterproof connector.
Figure 22:
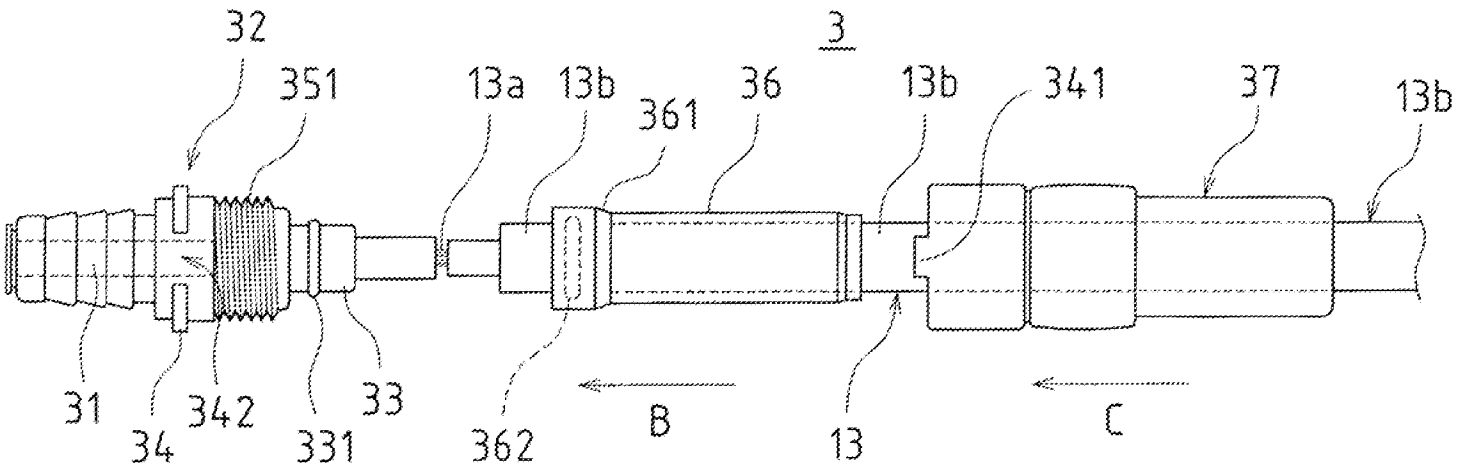
PRIOR ART FIG.22
FIG. 22 A side view illustrating the arrangement of components and assembly of the receptacle shown in FIG. 21.
Figure 23:
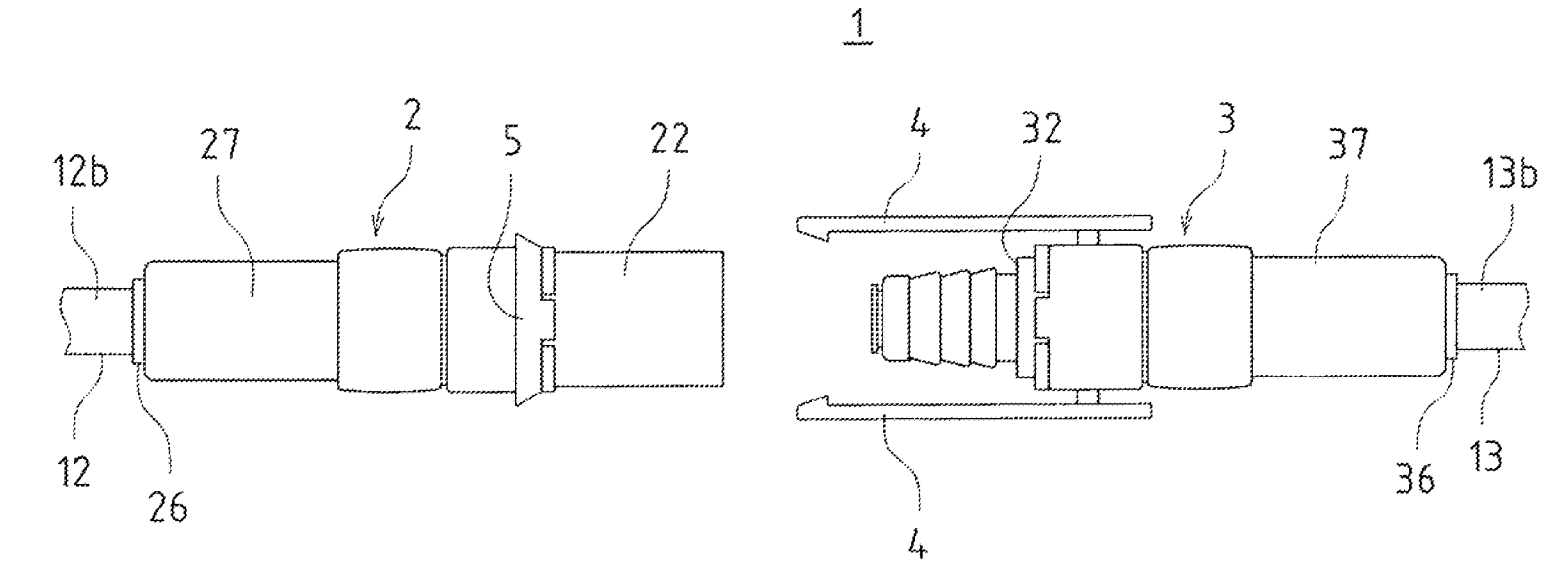
FIG.23 PRIOR ART
FIG. 23 A side view illustrating the plug and receptacle in a pre-engagement state in another embodiment of the conventional waterproof connector.

The inside diameter of the tubular rearward end portion 62 is slightly larger than the outside diameter obtained when the sleeve gasket 110 is fitted over the outer casing 122 of the cable 12. The tubular rearward end portion 62 is partitioned by multiple (in this example, 12) narrow score lines 65 extending in the axial direction. The score lines 65 are formed such that the central angles located about the axial center of the retaining sleeve 60 are each equal to 30 degrees. As a result of elastic deformation of the tubular rearward end portion 62 partitioned by the score lines 65, during which the side connected to the tubular intermediate portion 63 serves as a base, the diameter of the rearward end of the tubular rearward end portion 62 can be expanded and shrunk in a radial direction. However, as shown in FIG. 18, unlike the score lines 64 of the tubular forward end portion 61, the score lines 65 of the tubular rearward end portion 62 are formed at an angle of about 45 degrees to the radial direction passing through the axial center. Due to the fact that it becomes easier to avoid interference from adjacent portions on both sides of the score lines 65, this type of arrangement can ensure that the amount of deformation in a diameter-reducing direction is larger than the amount obtained when the score lines are formed in a radial direction. In addition, the peripheral edges at the rearward end of the tubular rearward end portion 62 are slightly chamfered.

The sleeve gasket 110 is a simple cylinder formed from a polymeric material of appropriate elasticity. The sleeve gasket 110 is inserted into the tubular rearward end portion 62 of the retaining sleeve 60 and comes in contact with a step portion 69 formed on the inner circumferential surface of the tubular rearward end portion 62, which holds so as to prevent it from advancing beyond the position, where its rearward end becomes aligned with that of the tubular rearward end portion 62. This sleeve gasket 110 fits over the outer casing 122 of the cable 12.

The plug-side main body housing 70 is a component, in which substantially half of the rearward end provided with a tubular bore 71 used to receive the retaining sleeve 60 and substantially half of the forward half side provided with a mating recess portion 72 interfitting with the receptacle 30 are molded in an integral fashion along the same axis.

The tubular bore 71, which is a round hole of a substantially constant diameter that opens towards the rearward end face of the plug-side main body housing 70, is formed along the axial center of the plug-side main body housing 70 up to about the middle of the plug-side main body housing 70. The depth of the tubular bore 71 is such that it can receive the tubular intermediate portion 63 and the tubular forward end portion 61 of the retaining sleeve 60. In addition, the inside diameter of the tubular bore 71 is such that it can subject the O-ring 112 fitted over the tubular intermediate portion 63 of the retaining sleeve 60 to pressure and deformation. A convergent tapered portion 73, whose diameter expands towards the rearward end face, is formed at the edge of the aperture at the rearward end of the tubular bore 71. The inside diameter of the rearward aperture face of the convergent tapered portion 73 is either nearly equal to, or slightly larger than, the outside diameter obtained in the non-deformed state of the O-ring 112 mounted inside the retaining sleeve 60.

The deep inner portion (forward portion) of the tubular bore 71 is in communication with a terminal gripping hole 74, which grips the base 42 of the male terminal 40 when substantially half of the forward end of the male terminal 40 is inserted therethrough. The cross-sectional shape of the terminal gripping hole 74 nearly coincides with the cross-sectional shape of the base 42 of the male terminal 40. Furthermore, a constricting tapered portion 75, whose diameter becomes narrower towards the forward end, is formed at the location of contact of the tubular forward end portion 61 of the retaining sleeve 60 in the deep inner portion of the tubular bore 71.

The exterior of the half of the rearward end surrounding the range extending from the tubular bore 71 to the terminal gripping hole 74 is shaped to link a substantially cylindrical male threaded portion 76 to a large-diameter hexahedral portion 77.

The mating recess portion 72 is an aperture that opens towards the forward end face and is in communication with the terminal gripping hole 74. The cross-sectional shape of the mating recess portion 72 at right angles to the axial direction is a so-called D-cut hole obtained by closing off part of a round hole using parallel planes, or a non-rotational shape obtained by effecting a D-cut using two opposed planes. The mating recess portion 72 surrounds the male terminal 40 with a predetermined gap between it and the peripheral surface at the forward end of the male terminal 40 and extends forwardly of the male terminal 40. The inside diameter of the mating recess portion 72 corresponds to the outside diameter of the mating projection portion 82 provided at the forward end of the hereinafter described receptacle 30, with an expanded-diameter portion 721 of a circular cross section provided in the vicinity of the forward end face.

The exterior of the substantially half of the forward end surrounding the mating recess portion 72 links a large-diameter hexahedral portion 77 to a small-diameter hexahedral portion 78 and then to an upset portion 79, which is obtained using two opposed parallel cut-off planes. The upset portion 79 is provided with an engagement portion 791 used for inserting the locking protuberances 891 of the hereinafter described receptacle 30. The configuration and action of the engagement portion 791 will be described in connection with the locking protuberances 891 of the receptacle 30.

The fastening nut 90 is a cylinder whose rearward end portion has a reduced diameter. A female threaded portion 91, which is threadably engaged with the male threaded portion 76 of the plug-side main body housing 70, is formed on the inner circumferential surface of the fastening nut 90. A constricting tapered portion 92, whose diameter becomes narrower towards the rearward end face, is formed in the deep inner portion (rearward portion) of the female threaded portion 91. A small step portion 93 is formed between the female threaded portion 91 and the constricting tapered portion 92. The inside diameter on the exterior of this step portion 93 coincides with the outside diameter of the tubular rearward end portion 62 in the retaining sleeve 60 before it narrows down. The rearward end of the constricting tapered portion 92 is a portion of a diameter somewhat larger than the outer casing 122 of the cable 12, which is open towards the rearward end face of the fastening nut 90. A finger grip section of a corrugated shape is formed on the outer circumferential surface of the fastening nut 90. The rearward end portion of the fastening nut 90 is a small-diameter hexahedral portion 94.

Figure 6:
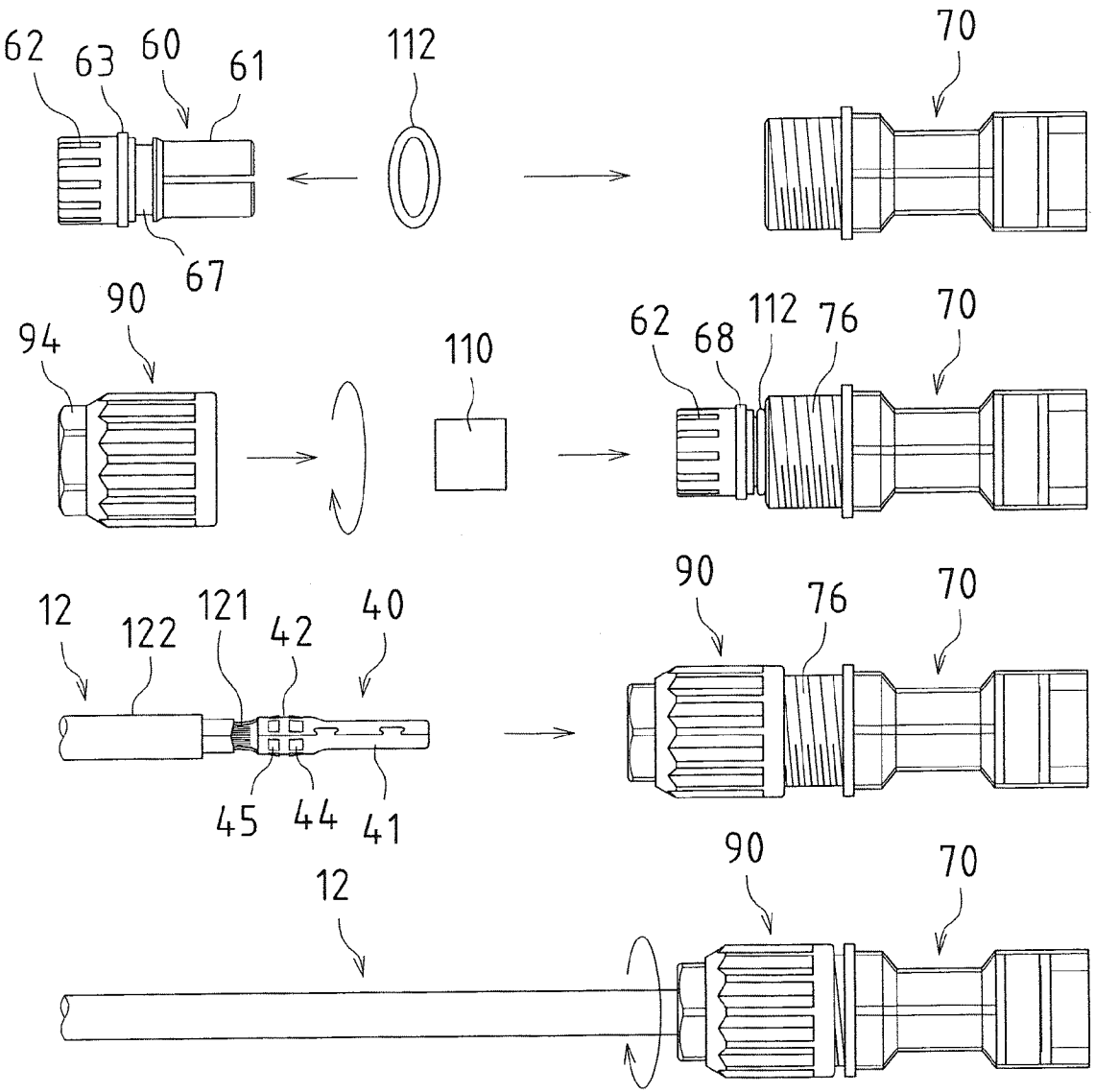
FIG. 6 An illustrative drawing showing the plug assembly procedure.
Figure 7:
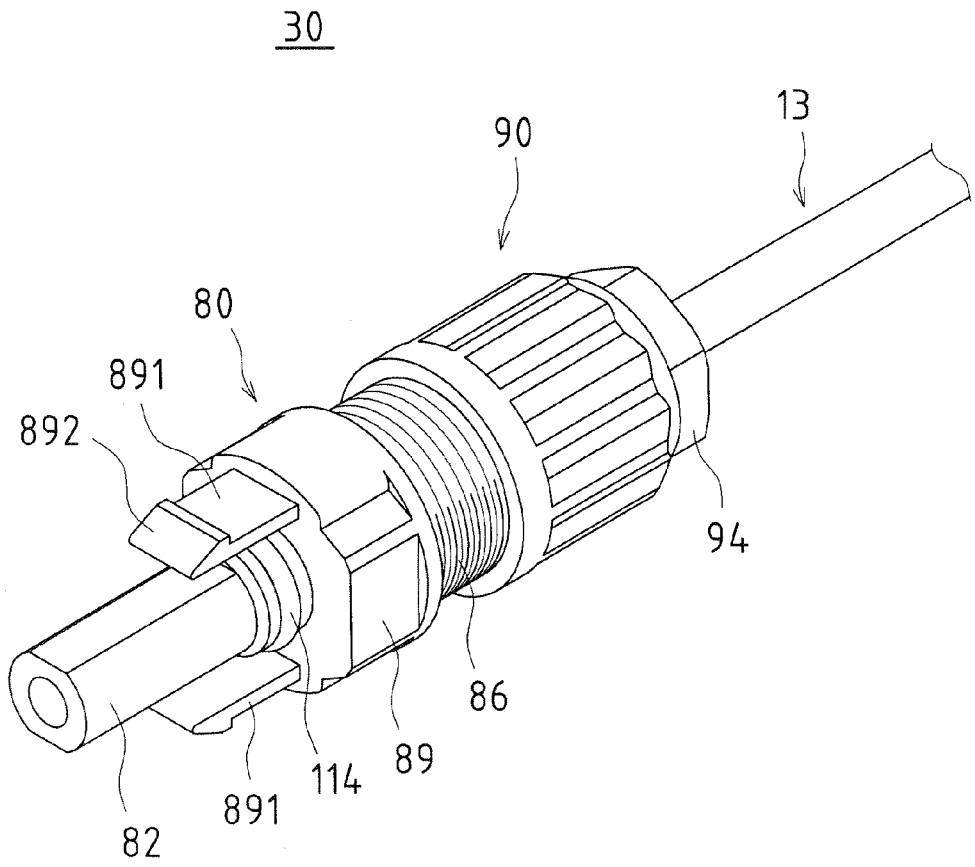
FIG. 7 An oblique view illustrating the overall shape of the receptacle according to Embodiment 2 of the inventive waterproof connector.
Figure 8:
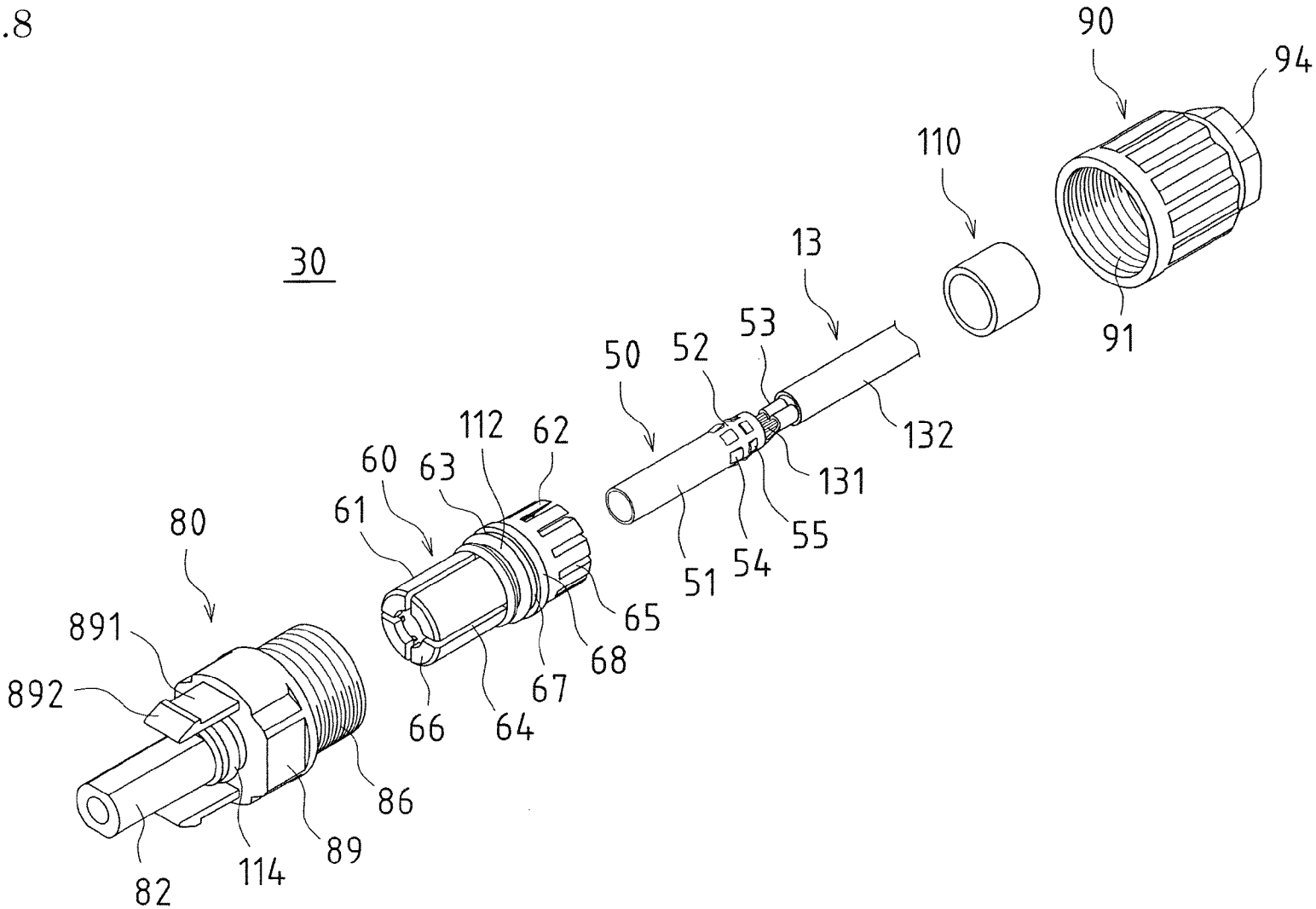
FIG. 8 An exploded oblique view illustrating the arrangement of components in the receptacle.

The procedure used to assemble the plug 20 made up of these components will be described with reference to FIGS. 3, 4 and FIG. 6. First of all, the O-ring 112 is mounted in the recessed groove 67 formed in the tubular intermediate portion 63 of the retaining sleeve 60. The retaining sleeve 60 is then inserted, with its tubular forward end portion 61 first, into the tubular bore 71 of the plug-side main body housing 70. Once the O-ring 112 mounted on the retaining sleeve 60 comes in contact with the convergent tapered portion 73 formed in the tubular bore 71 of the plug-side main body housing 70, the insertion of the retaining sleeve 60 stops.

Next, the sleeve gasket 110 is inserted inside the tubular rearward end portion 62 of the retaining sleeve 60. The sleeve gasket 110 is positioned such that when it comes in contact with the step portion 69 formed on the inner circumferential surface of the tubular rearward end portion 62, its rearward end becomes mutually aligned with the tubular rearward end portion 62.

The fastening nut 90 is then threadably engaged with the male threaded portion 76 of the plug-side main body housing 70. This screwing operation is performed by applying light pressure manually, without using tightening tools, etc. Once the step portion 93 formed in the inner surface of the fastening nut 90 comes in contact with the tubular rearward end portion 62 of the retaining sleeve 60, the O-ring 112, which is in contact with the convergent tapered portion 73 of the tubular bore 71, offers resistance, as a result of which the operation of screwing on the fastening nut 90 becomes more difficult and the screwing operation stops.

Subsequently, the male terminal 40, which is bonded to the conductor 121 of the cable 12, is inserted inside the retaining sleeve 60 through the rearward end of the fastening nut 90. When the male terminal 40 is pushed in until the forward end of the male terminal 40 protrudes into the mating recess portion 72 of the plug-side main body housing 70, the detent projection portions 44 formed on the base 42 of the terminal 40 pass through the hole surrounded by the hook-shaped portions 66 while spreading apart the hook-shaped portions 66 formed in the tubular forward end portion 61 of the retaining sleeve 60. The detent projection portions 44 then "snap" in with a click and engage with the forward end faces of the hook-shaped portions 66, as a result of which the male terminal 40 is provisionally held in place such that it cannot be removed from inside the retaining sleeve 60. Simultaneously, the positioning projection portions 45 formed on the base 42 of the male terminal 40 come in contact with the rearward end faces of hook-shaped portions 66 and deeper insertion of the male terminal 40 is precluded. In this manner, the male terminal 40 is maintained in a pre-assembled state in an appropriate position inside the retaining sleeve 60. If the protrusion height of the detent projection portions 44 is not too high, then even in this pre-assembled state, the male terminal 40 can be extracted from the retaining sleeve 60 by pulling the cable 12 with some force.

Figure 3:
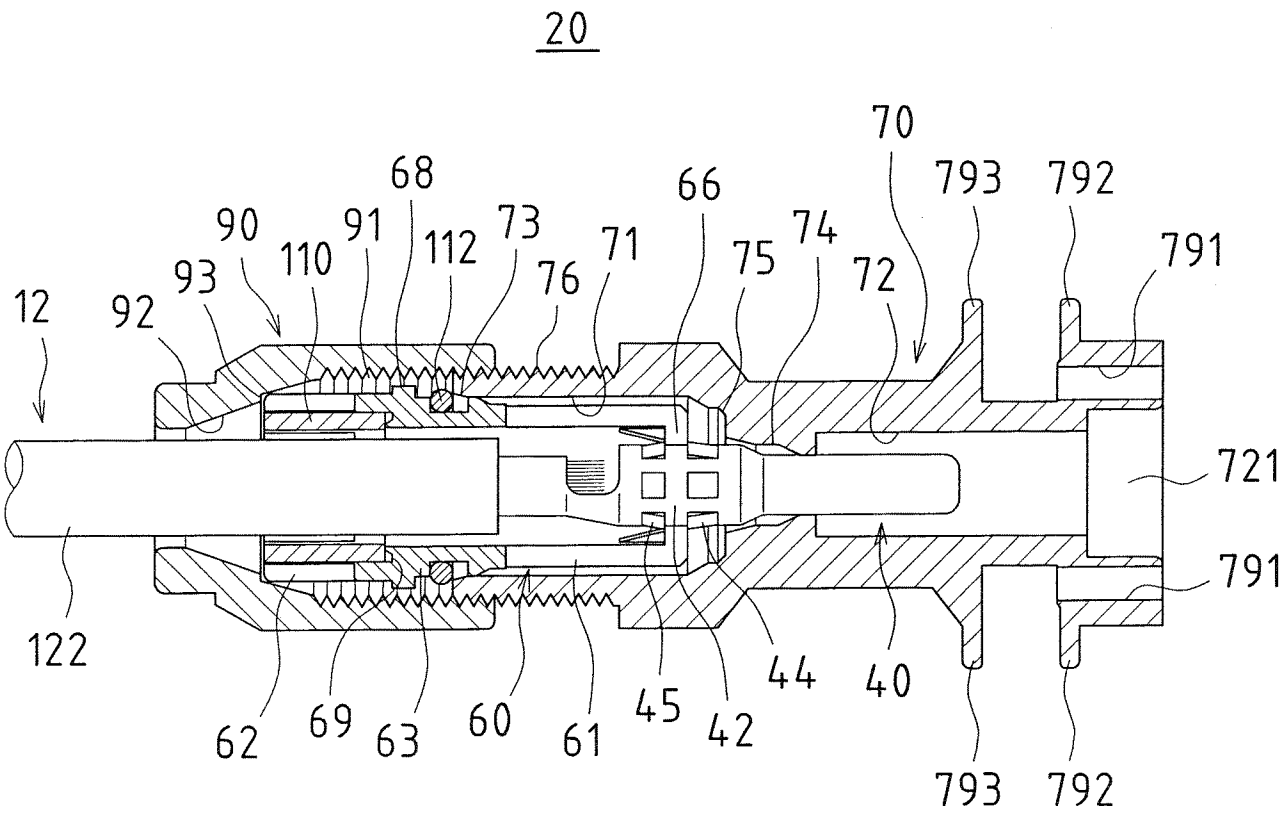
FIG. 3 A longitudinal axial cross-sectional view of the plug in a pre-assembled state.
Figure 4:
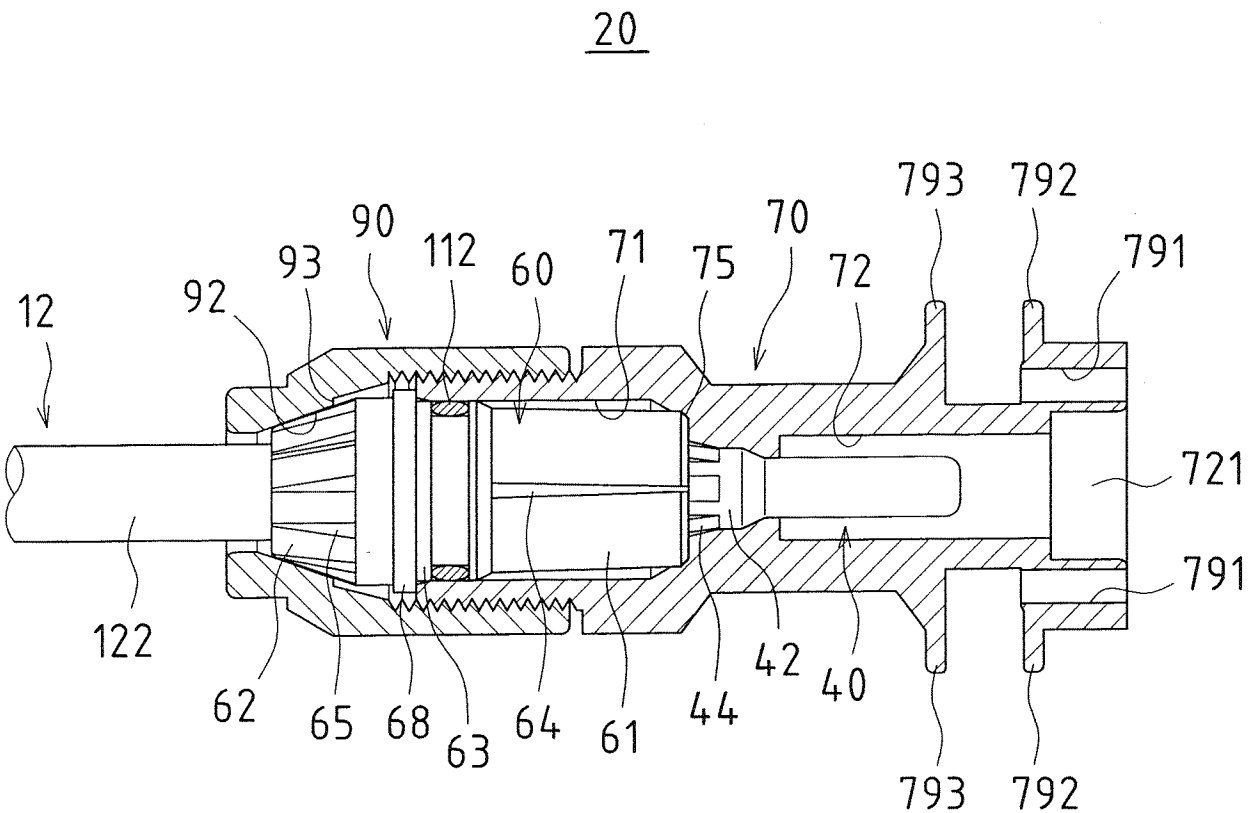
FIG. 4 A longitudinal axial cross-sectional view of the plug in a permanently assembled state.
Figure 5:
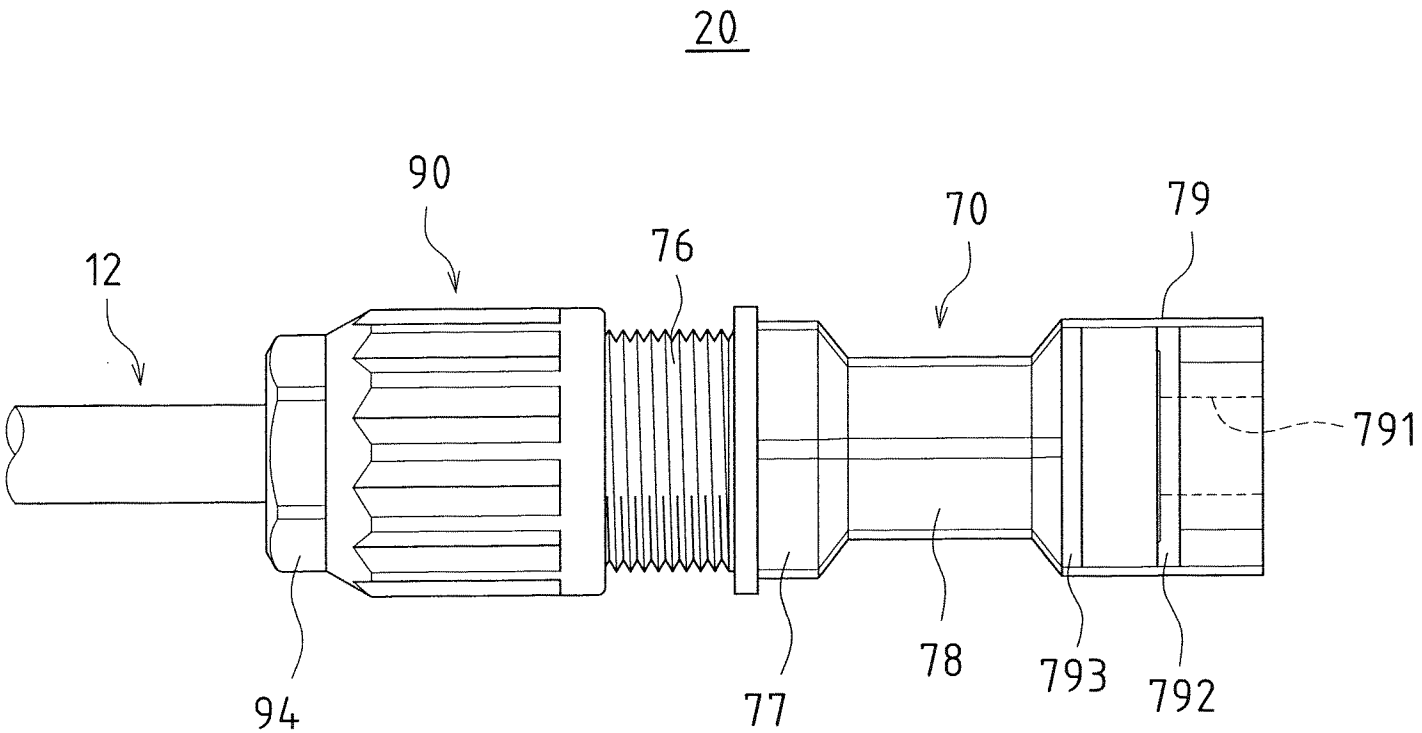
FIG. 5 A top view of the plug.

FIG. 3 is a cross-sectional view of this pre-assembled state. When the male terminal 40 is inserted, it is subject to resistance as the detent projection portions 44 try to spread the hook-shaped portions 66 apart. Accordingly, a suitably rigid O-ring 112 is used to make the force required for the compressive deformation of the O-ring 112 larger than the above-mentioned resistance. If this is done, then even if the male terminal 40 is pushed into the retaining sleeve 60, the retaining sleeve 60 stops at the position where the O-ring 112 comes in contact with the convergent tapered portion 73 of the tubular bore 71 and is suitably maintained in a state, in which the tubular forward end portion 61 does not reach into the deep inner portion of the tubular bore 71. Since no scattering of components can take place in this pre-assembled state, adjustment and checkup operations can be carried out at a work location as necessary.

Subsequently, permanent assembly is carried out if there are no particular problems in the pre-assembled state. During the permanent assembly, the fastening nut 90 is securely tightened on the plug-side main body housing 70. If necessary, during the permanent assembly operation, the screwing operation is performed by holding the hexahedral portions 94, 77, and 78 of the plug-side main body housing 70 and the fastening nut 90 using a tightening tool, such as a wrench. As shown in FIG. 4, when the fastening nut 90 is tightened, the step portion 69 formed on the inner circumferential surface of the fastening nut 90 pushes the tubular rearward end portion 62 of the retaining sleeve 90 farther towards the distal end. As a result, the retaining sleeve 60 subjects the O-ring 112 fitted over the tubular intermediate portion 63 to deformation while penetrating farther inside the tubular bore 71 of the plug-side main body housing 70 together with the male terminal 40. The O-ring 112, which is subjected to pressure and deformation inside the tubular bore 71, seals the gap between the tubular bore 71 and retaining sleeve 60 in a watertight manner.

When the large-diameter step portion 68 formed in the outer circumferential surface of the retaining sleeve 60 comes in contact with the rearward end of the plug-side main body housing 70, the tubular forward end portion 61 of the retaining sleeve 60 comes in contact with the constricting tapered portions 75 formed in the deep inner portion of the tubular bore 71. As a result, the tubular forward end portion 61 is clamped by narrowing the score lines 64, and the hook-shaped portions 66 formed at the forward end grip the base 42 of the male terminal 40.

Furthermore, when the fastening nut 90 is tightened, the retaining sleeve 60 cannot advance any farther into the tubular bore 71, as a result of which the tubular rearward end portion 62 of the retaining sleeve 60 clamped by the constricting tapered portions 92 of the fastening nut 90 is pushed towards the axial center and its diameter is shrunk by narrowing the score lines 65. As a result, the tubular rearward end portion 62 of the retaining sleeve 60 firmly grips the outer casing 122 of the cable 12 through the medium of the sleeve gasket 110 and seals the gap therebetween in a watertight manner.

As a result of using this type of configuration, the resistance to the operation of tightening of the fastening nut 90 is increased in a stepwise manner, thereby providing a clear-cut haptic response when transitioning from a pre-assembled state to a permanently assembled state. In addition, as the retaining sleeve 60 moves from a pre-assembled position to a permanently assembled position, first the tubular forward end portion 61 of the retaining sleeve 60, and then the tubular rearward end portion 62 are consecutively subjected to appropriate clamping.

<Receptacle 30>

Next, the configuration of the receptacle 30 will be described in detail with reference to FIGS. 7-12. In the same manner as the plug 20 described above, the receptacle 30 is formed by assembling six components including a female terminal 50 attached to a cable 13, a retaining sleeve 60 of a substantially cylindrical shape mounted on the exterior of the cable 13 and female terminal 50, a sleeve gasket 110 interposed between the cable 13 and retaining sleeve 60, an O-ring 112 fitted over the outer peripheral surface of the retaining sleeve 60, a receptacle-side main body housing 80 receiving the retaining sleeve 60, and a fastening nut 90 mounted on the rearward end of the receptacle-side main body housing 80. Among these components, the retaining sleeve 60, O-ring 112, sleeve gasket 110, and fastening nut 90 are absolutely identical to the above-described components constituting the plug 20. These identical components are assigned the same reference numerals as those mentioned above, and the corresponding explanations are omitted.

The female terminal 50 is formed by rolling electrically conductive sheet metal material into an elongated cylindrical configuration. Substantially half of the forward end of the female terminal 50 is a large-diameter portion 51 mounted onto the male terminal 40 of the above-described plug 20, with this large-diameter portion 51 and the base 52 of the intermediate portion formed to have nearly identical diameters. The crimp-joint portion 53 of a substantially U-shaped cross-section provided in the rearward end portion of the female terminal 50, as well as the detent projection portions 54 and positioning projection portions 55 formed on the base 52 of the female terminal 50, are identical to those of the male terminal 40.

The receptacle-side main body housing 80 is a component, in which substantially half of the rearward end provided with a tubular bore 81 used for receiving the retaining sleeve 60 and substantially half of the forward half side provided with a mating projection portion 82 interfitting with the plug 20 are molded in an integral fashion along the same axis. The internal shape of the tubular bore 81 is identical to the internal shape of the tubular bore 71 of the above-described plug-side main body housing 70. The deep inner portion (forward portion) of the tubular bore 81 is in communication with the terminal gripping hole 84, which matches the cross-sectional shape of the female terminal 50. The configuration is similar to the plug-side main body housing 70 in that the constricting tapered portions 85, which reduce the diameter of the tubular forward end portion 61 of the retaining sleeve 60, are formed in the deep inner portion of the tubular bore 81.

The exterior of the receptacle-side main body housing 80 links a substantially cylindrical male threaded portion 86 formed at the rearward end to an upset portion 89 produced using two opposed parallel cutoff planes, with a substantially cylindrical mating projection portion 82 shaped as a protrusion forwardly of the upset portion 89. The mating projection portion 82 surrounds the female terminal 50 while being in contact with the outer circumferential surface of the female terminal 50, and, furthermore, extends forwardly of the female terminal 50. The cross-sectional shape of the mating projection portion 82 at right angles to the axial direction is a so-called D-cut shape obtained by cutting off part of a round cylinder with parallel planes, or a non-rotational shape obtained by performing a D-cut using two opposed planes.

The outside diameter of the mating projection portion 82 corresponds to the inside diameter of the mating recess portion 72 provided at the forward end of the above-described plug 20 and a expanded-diameter portion 821 of a circular cross section is formed in the vicinity of the upset portion 89. A recessed groove 822 is formed in the circumferential direction on this expanded-diameter portion 821. An O-ring 114 made up of a polymeric material of appropriate elasticity is press-fitted into this recessed groove. When the mating projection portion 82 is fitted in the mating recess portion 72 provided in the plug 20, this O-ring 114 is subjected to pressure and deformation inside the expanded-diameter portion 721 of a circular cross section formed in the vicinity of the forward end face of the mating recess portion 72 and the gap between the mating projection portion 82 and mating recess portion 72 is sealed in a watertight manner. The upset portion 89 is provided with a pair of upper and lower locking protuberances 891 inserted into the engagement portion 791 of the plug 20. The configuration and action of the locking protuberances 891 will be described in connection with the engagement portion 791 of the plug 20.

Figure 12:
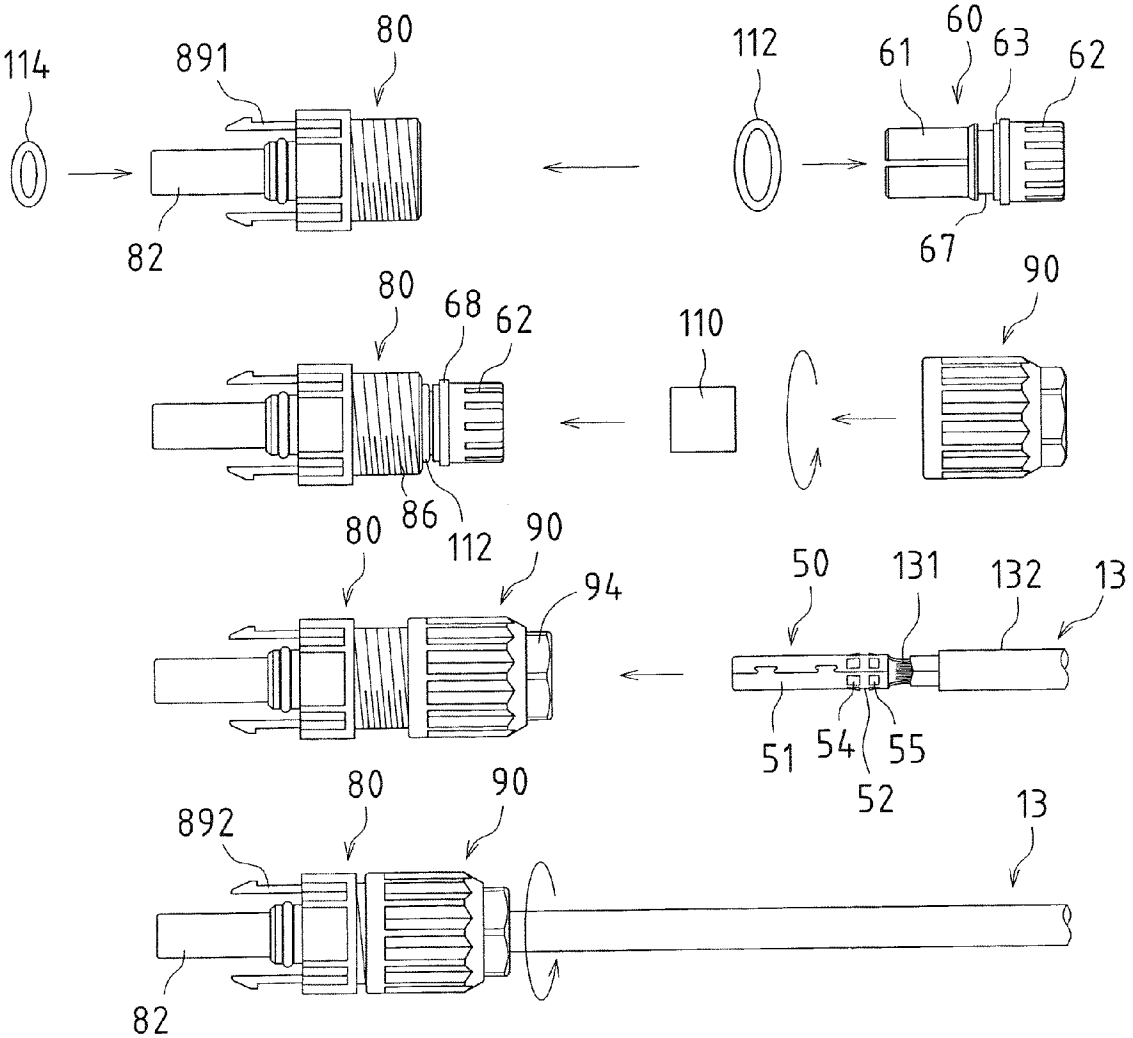
FIG. 12 An illustrative drawing showing the receptacle assembly procedure.
Figure 13:
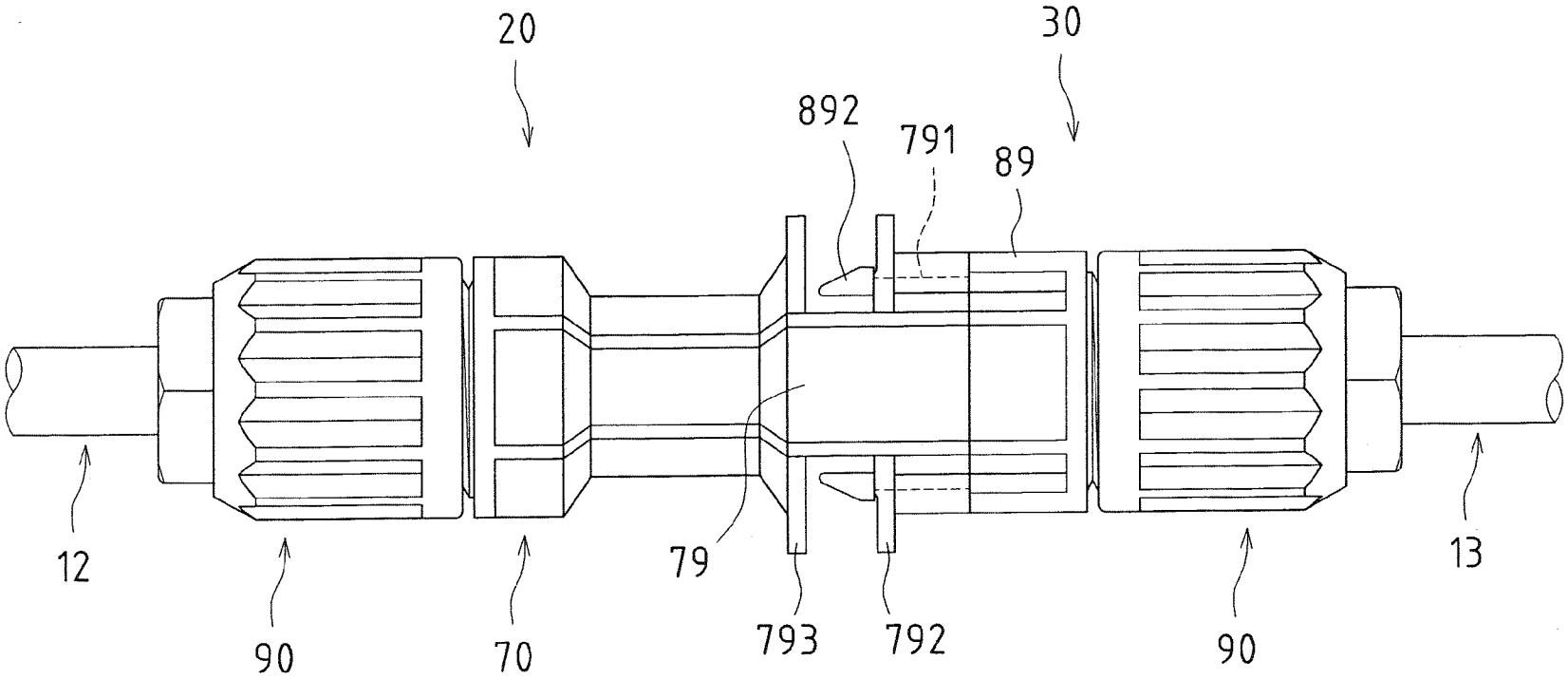
FIG. 13 A side view illustrating a state, in which the plug is interfitted with the receptacle.
Figure 14:
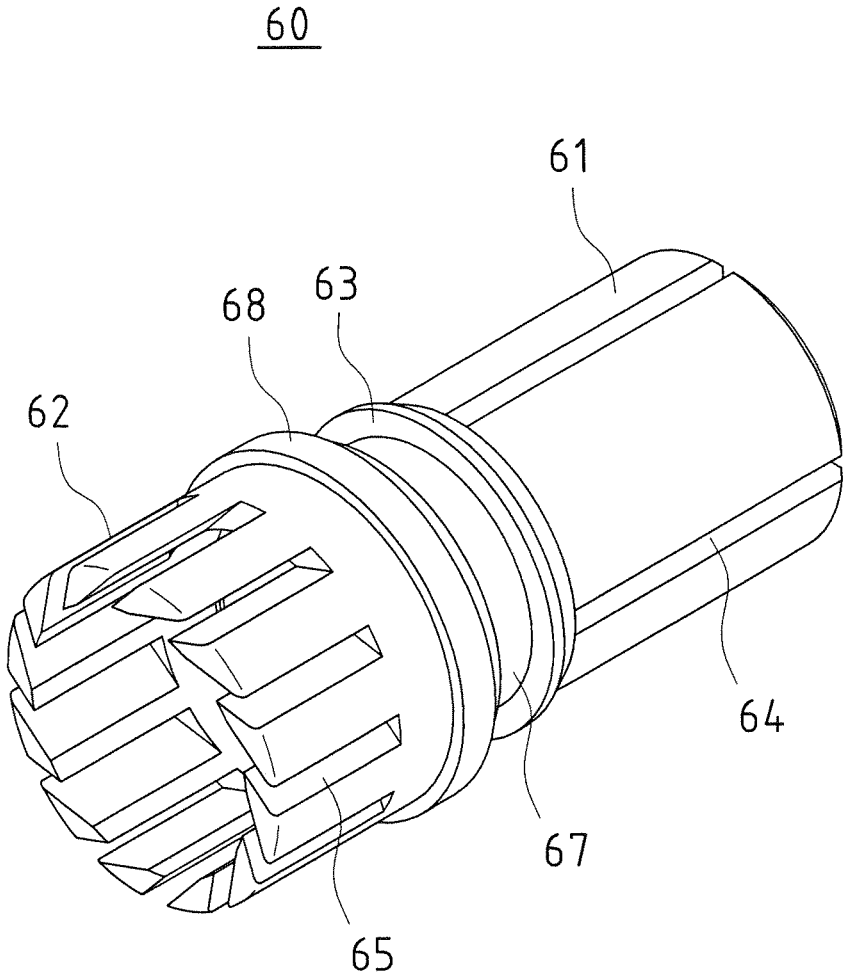
FIG. 14 An oblique view illustrating the overall shape of the retaining sleeve comprising the plug and receptacle.
Figure 15:
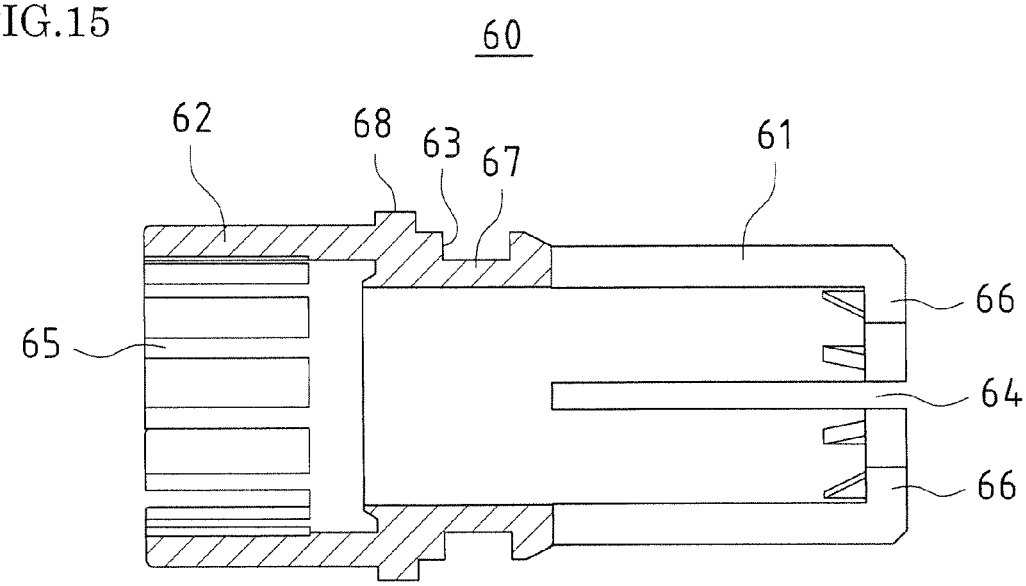
FIG. 15 A longitudinal axial cross-sectional view of the retaining sleeve.
Figure 16:
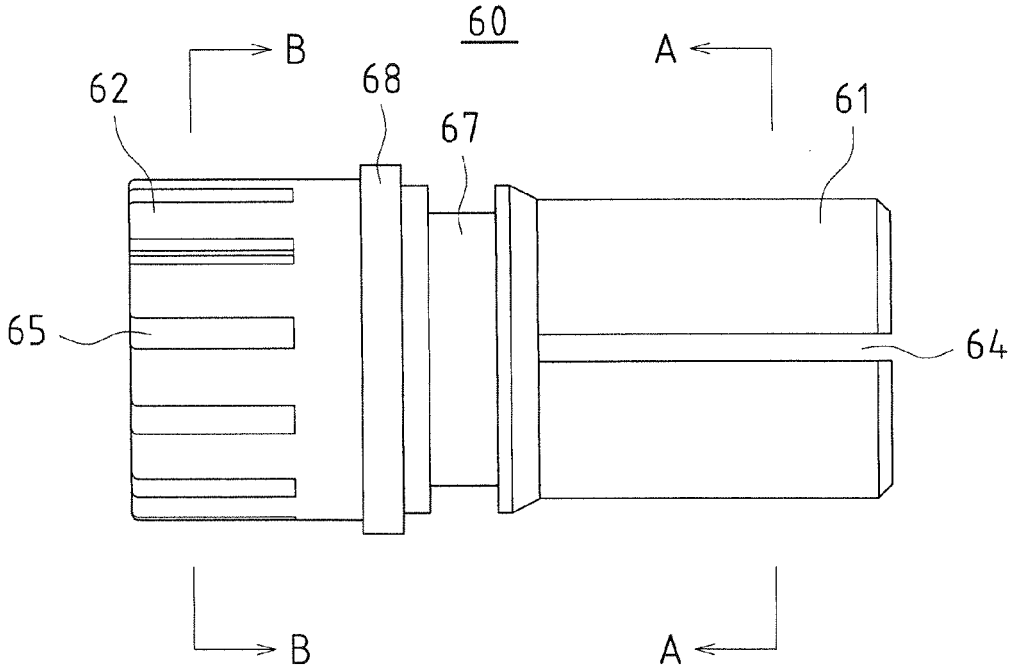
FIG. 16 A side view of the retaining sleeve.

FIG. 12 illustrates the procedure used to assemble the receptacle 30. The procedure used to assemble the receptacle 30 is fundamentally similar to the assembly procedure of the plug 20.

Namely, an O-ring 112 is pre-mounted in the recessed groove 67 formed in the tubular intermediate portion 63 of the retaining sleeve 60. In addition, an O-ring 114 is also pre-mounted on the mating projection portion 82 of the receptacle-side main body housing 80. The retaining sleeve 60 is then inserted, with its tubular forward end portion 61 first, into the tubular bore 81 of the receptacle-side main body housing 80. Once the O-ring 112 mounted on the retaining sleeve 60 comes in contact with the convergent tapered portion 83 formed in the tubular bore 81 of the receptacle-side main body housing 80, the insertion of the retaining sleeve 60 stops.

Next, the sleeve gasket 110 is inserted inside the tubular rearward end portion 62 of the retaining sleeve 60. The fastening nut 90 is then threadably engaged with the male threaded portion 86 of the receptacle-side main body housing 80 and provisionally tightened until the step portion 93 of the fastening nut 90 comes in contact with the tubular rearward end portion 62 of the retaining sleeve 60.

Figure 9:
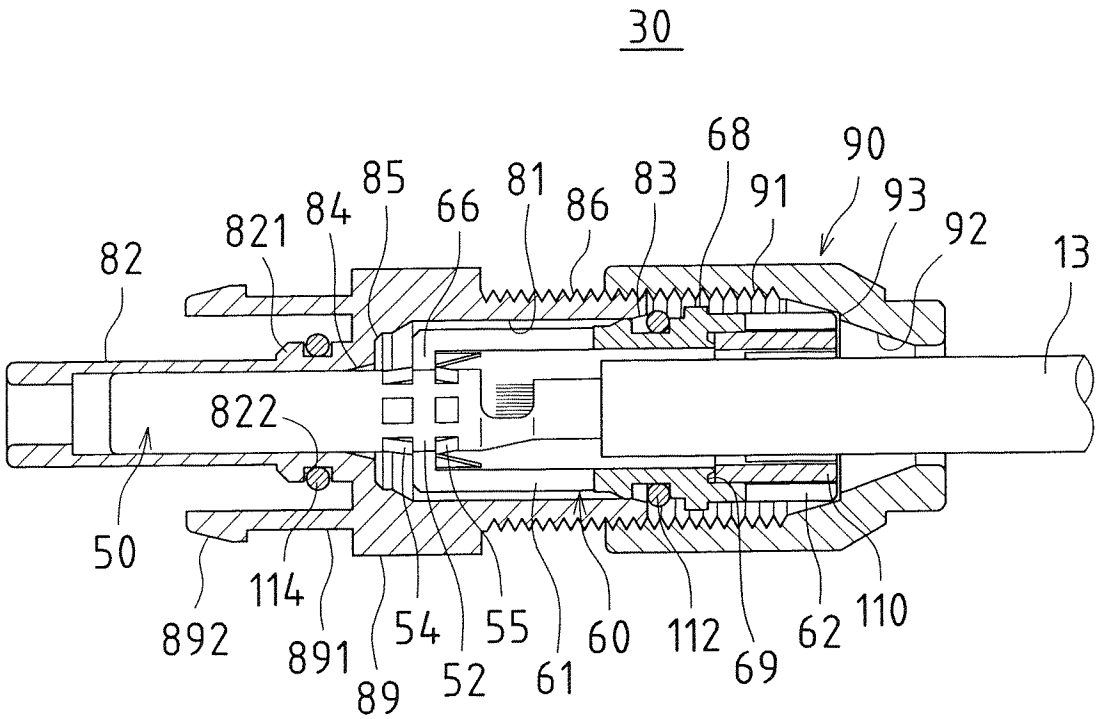
FIG. 9 A longitudinal axial cross-sectional view of the receptacle in a pre-assembled state.

Subsequently, the female terminal 50 bonded to the conductor 131 of the cable 13 is inserted inside the retaining sleeve 60 through the rearward end of the fastening nut 90 and the detent projection portions 54 of the female terminal 50 are engaged with the hook-shaped portions 66 of the retaining sleeve 60, thereby provisionally holding the female terminal 50 in place. FIG. 9 is a cross-sectional view of the receptacle 30 in a pre-assembled state. The action of the O-ring 112 is also identical to the action of the O-ring 112 in the above-described plug 20. Since no scattering of components can take place in this pre-assembled state, adjustment and checkup operations can be easily performed at a work location.

Figure 10:
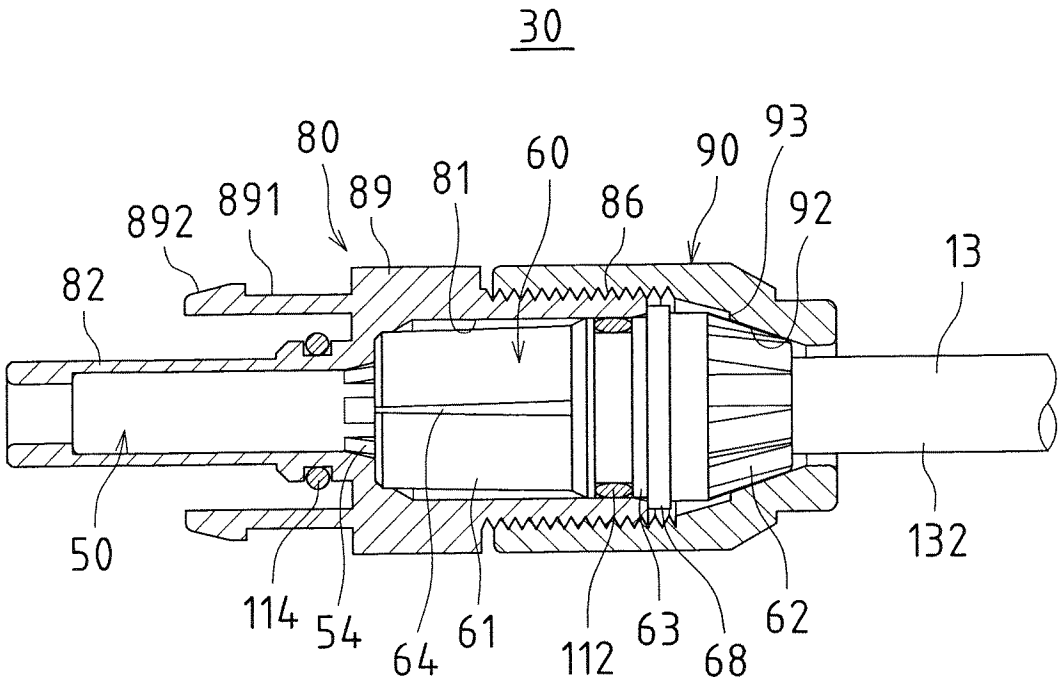
FIG. 10 A longitudinal axial cross-sectional view of the receptacle in a permanently assembled state.
Figure 11:
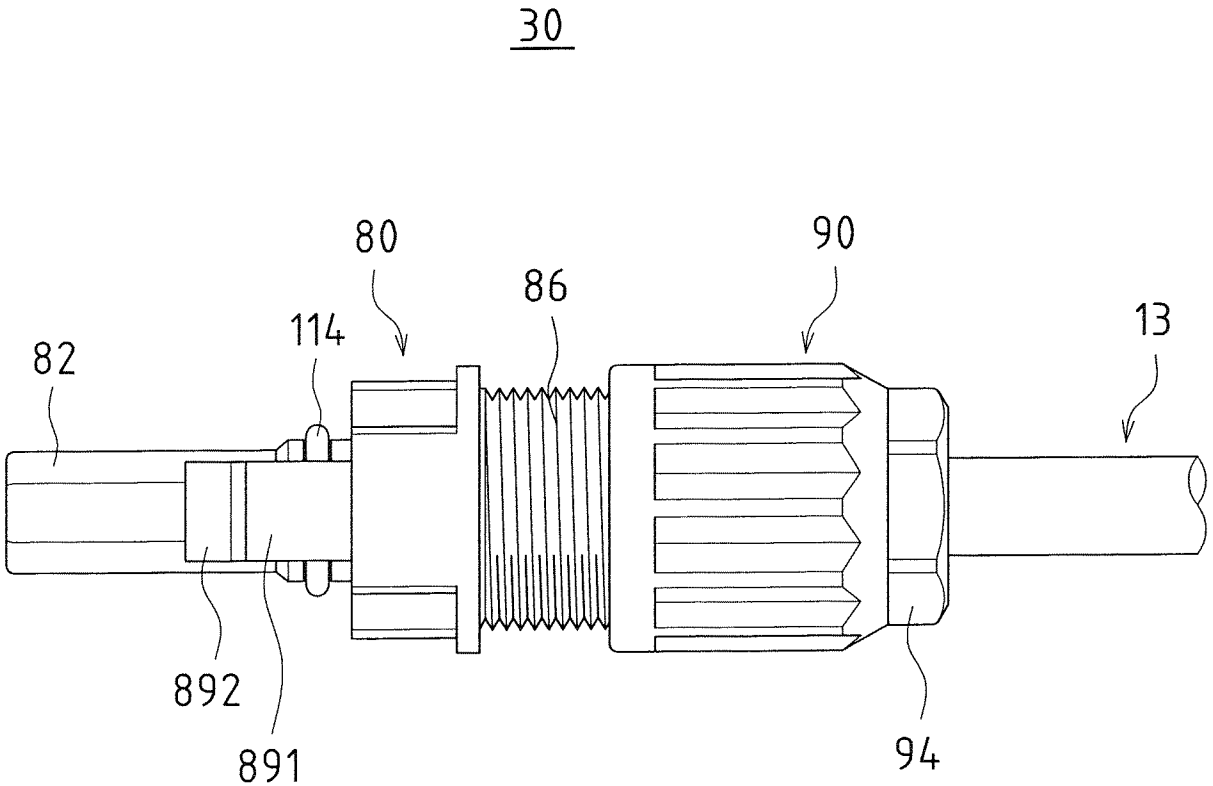
FIG. 11 A top view of the receptacle.

As shown in FIG. 10, permanent assembly involves securely tightening the fastening nut 90 on the receptacle-side main body housing 80, thereby pushing the retaining sleeve 60 farther inside the tubular bore 81. As a result, the O-ring 112 fitted over the tubular intermediate portion 63 of the retaining sleeve 60 is subjected to pressure and deformation inside the tubular bore 81 and seals the tubular bore 81 in a watertight manner. When the tubular forward end portion 61 of the retaining sleeve 60 comes in contact with the tapered portion 85 formed in the deep inner portion of the tubular bore 81, the tubular forward end portion 61 is clamped and the hook-shaped portions 66 grip the base 52 of the female terminal 50. Furthermore, when the fastening nut 90 is tightened, the diameter of the tubular rearward end portion 62 of the retaining sleeve 60 clamped by the constricting tapered portions 92 is reduced, thereby sealing the gap with the outer casing 132 of the cable 13 through the medium of the sleeve gasket 110 in a watertight manner.

If this type of component arrangement is used, the inventive waterproof connector makes it possible to easily pre-assemble the components and perform permanent assembly without scattering the components, no matter whether it is the plug 20 or receptacle 30. In addition, it can also ensure proper watertightness around the terminal.

<Interfitted Structure>

The interfitted structure of the plug 20 and receptacle 30 will be described next. FIG. 13 illustrates a state, in which the plug 20 and receptacle 30 are interfitted with each other.

A pair of forwardly extending upper and lower locking protuberances 891 are provided in the upset portion 89 of the receptacle-side main body housing 80. The length of the locking protuberances 891 is about half the length of the mating projection portion 82. The locking protuberances 891 are molded integrally with the receptacle-side main body housing 80 so as to be able to undergo elastic deformation in the vertical direction, with the upset portion 89 serving as a base. Locking pawls 892 with "burrs" on the outside (facing away from the axial center) are formed at in distal end portions of the locking protuberances 891.

On the other hand, the upset portion 79 of the plug-side main body housing 70 is provided with a tubular engagement portion 791 used for inserting the locking protuberances 891 provided in the receptacle 30. The engagement portion 791 passes through the upset portion 79 in the axial direction. When the plug 20 and receptacle 30 are interfitted, the locking protuberances 891 are inserted into the engagement portion 791 in a state, in which the locking protuberances 891 are slightly bent towards the axial center. When the locking pawls 892 formed at the distal ends of the locking protuberances 891 pass through the engagement portion 791, the locking protuberances 891 outwardly elastically rebound and the locking pawls 892 become engaged with the rearward end face of the engagement portion 791, thereby offering resistance to removal of the locking protuberances 891.

When the locking pawls 892 are subjected to pressure due to inadvertent fingertip manipulations, external impact, and the like in this engaged state, the locking protuberances 891 undergo deformation towards the axial center, which creates the risk of removal from the engagement portion 791. Accordingly, in the present invention, guard ribs 792, 793 are provided at the rearward end of the engagement portion 791 in the plug-side main body housing 70 in order to prevent external forces from acting on the locking pawls 892.

The guard ribs 792, 793, which are located in the vicinity of the edge of the aperture at the rearward end of the engagement portion 791 as well as at a rearwardly retracted position, stand at right angles to the direction of passage of the engagement portion 791. The gap between the guard ribs 792, 793 is such that it does not permit entry of a human fingertip, i.e. more specifically, about 4-9 mm. In addition, the height of the guard ribs 792, 793 is such that it does not allow for the locking pawls 892 to be touched with a human fingertip, more specifically, it is generally greater than 3 mm, which is adjusted with account taken of the gap between the ribs. When the plug 20 and receptacle 30 are removed, the upper and lower locking pawls 892 are squeezed between the guard ribs 792, 793 using, for example, pliers and appropriate special jigs, whereupon they are withdrawn from the engagement portion 791.

Thus, due to being provided with means for protecting the interfitment between the plug 20 and receptacle 30, the inventive waterproof connector can connect the plug 20 to the receptacle 30 in a reliable manner for an extended period of time.

Industrial Applicability

In addition to being useful as a means for providing through-connections for outdoor cabling such as electric power cables used for solar battery modules, the inventive waterproof connector can be used indoors and outdoors for connecting both thick and thin electric cables of various cross-sectional dimensions.

REFERENCE SIGNS LIST

110 Sleeve gasket
112 O-ring
12 Cable
121 Conductor
122 Outer casing
13 Cable
131 Conductor
132 Outer casing
20 Plug
30 Receptacle
40 Male terminal
42 Base
44 Detent projection portion
45 Positioning projection portion
50 Female terminal
52 Base
54 Detent projection portion
55 Positioning projection portion
60 Retaining sleeve
61 Tubular forward end portion
62 Tubular rearward end portion
63 Tubular intermediate portion
64 Score line
65 Score line
66 Hook-shaped portion
70 Plug-side main body housing
71 Tubular bore
72 Mating recess portion
73 Convergent tapered portion
75 Constricting tapered portion
76 Male threaded portion
77 Hexahedral portion
78 Hexahedral portion
791 Engagement portion
792 Guard rib
793 Guard rib
80 Receptacle-side main body housing
82 Mating projection portion
81 Tubular bore
85 Constricting tapered portion
86 Male threaded portion
90 Fastening nut
91 Female threaded portion
92 Constricting tapered portion
93 Stepped portion
94 Hexahedral portion

The invention claimed is:

1. A water-proof connector comprising:
a terminal,
a retaining sleeve,
a main body housing, and
a fastening nut, wherein
the terminal has an elongate rod-like or tubular shape and its rearward end is compression bonded to a conductor of a cable, and the terminal has, on an outer periphery in a vicinity of the rearward end, a plurality of projection portions;
the retaining sleeve is mounted in the vicinity of the rearward end of the terminal and across the outer casing of the cable, on the outside thereof;
the main body housing has a tubular bore receiving the retaining sleeve and substantially half of the forward end of the retaining sleeve is inserted into the tubular bore;
a male threaded portion is formed on the exterior of the tubular bore in the main body housing;
the fastening nut has a female threaded portion formed on the inside thereof and is mounted onto the main body housing while threadably engaging the female threaded portion with the male threaded portion;
the retaining sleeve includes, in the forward end and the rearward end thereof, respective axial score lines, and includes on a tubular forward end portion thereof, hook-shaped portions protruding towards an axial center, the hook-shaped portions being engaged with the projection portions of the terminal;
constricting tapered portions clamping the score lines in the rearward end of the retaining sleeve are provided in an inner periphery of the fastening nut; and
the rearward end of the retaining sleeve is subjected to deformation in a diameter-reducing direction so as to be gripped by the fastening nut.

2. A water-proof mono-axial connector provided at the end of a cable, either as a plug having a male terminal or as a receptacle having a female terminal, comprising:
a terminal of an elongate rod-like or tubular shape having its rearward end compression bonded to a conductor of the cable;
a retaining sleeve mounted in the vicinity of the rearward end of the terminal and across the outer casing of the cable, on the outside thereof;
a main body housing having formed therein a tubular bore that receives the retaining sleeve;
a fastening nut mounted at the rearward end of the main body housing,
wherein
substantially half of the forward end of the retaining sleeve is inserted into the tubular bore formed in the main body housing;

the fastening nut is threadably engaged with the male threaded portion formed on the exterior of the tubular bore; and a plurality of projection portions is provided on an outer periphery of the terminal in a vicinity of the rearward end thereof;

the retaining sleeve includes, in the forward end and the rearward end thereof, respective axial score lines, and includes, on a tubular forward end portion thereof, hook-shaped portions protruding towards an axial center, the hook-shaped portions being engage with the projection portions of the terminal;

constricting tapered portions clamping the score lines in the rearward end of the retaining sleeve are provided in an inner periphery of the fastening nut; and the rearward end of the retaining sleeve grips the terminal and the outer casing of the cable in a watertight manner.

3. The water-proof connector according to claims 1 or 2, wherein the retaining sleeve comprises the tubular forward end portion surrounding the vicinity of the rearward end of the terminal, a tubular rearward end portion surrounding the outer casing of the cable, and a tubular intermediate portion linking the above, and the tubular forward end portion and the tubular rearward end portion are rendered deformable in a diameter-reducing direction by the respective axial score lines, which are formed in multiple locations therein, and the constricting tapered portions clamping the retaining sleeve are formed at respective locations of the fastening nut and the tubular bore of the main body housing that come in contact with the retaining sleeve.

4. The water-proof connector according to claim 3, wherein the retaining sleeve is formed such that the hook-shaped portions protruding towards the axial center are formed in the tubular forward end portion of the retaining sleeve and the terminal bonded to the cable is inserted, with its forward end first, into the rearward end of the retaining sleeve; and detent projection portions which, during insertion into the retaining sleeve, spread the hook-shaped portions apart and engage with the forward end face of the hook-shaped portions, thereby resisting removal from inside the retaining sleeve, and positioning projection portions, which come in contact with the rearward end face of the hook-shaped portions, are formed in the vicinity of the rearward end of the terminal.

5. The water-proof connector according to claim 4, wherein the terminal is formed by rolling up electrically conductive sheet metal material into a cylindrical shape and at least either the detent projection portions or the positioning projection portions are formed b punching the sheet material in a squared C-shape (squared U-shape) and bending the punched portions up by a small slant angle.

6. The water-proof connector according to claim 3, wherein the score lines fanned at least either in the tubular forward end portion or in the tubular rearward end portion of the retaining sleeve are formed such that the retaining sleeve is partitioned at an angle to the radial direction passing through the axial center of the retaining sleeve.

7. The water-proof connector according to claim 3, wherein a tubular sleeve gasket made up of an elastic polymeric material is interposed between the tubular rearward end portion of the retaining sleeve and the outer casing of the cable.

8. The water-proof connector according to claim 3, wherein an annular O-ring made up of an elastic polymeric material is mounted around the outer periphery of the tubular intermediate portion of the retaining sleeve and this O-ring is press fitted into the tubular bore of the main body housing by inserting the retaining sleeve into the tubular bore.

9. The water-proof connector according to claim 8, wherein a convergent tapered portion that provisionally retains the O-ring mounted on the retaining sleeve in a state free from compressive deformation is formed at the edge or in the vicinity of the aperture at the rearward end of the tubular bore provided in the main body housing.

10. The water-proof connector according to claim 1 or 2, wherein a hexahedral portion of equilateral hexagonal cross-sectional shape normal to the axial direction is formed in the main body housing and the fastening nut.

11. The water-proof connector according to claim 1 or 2, wherein a tubular engagement portion that opens at the forward end of the main body housing and passes through the main body housing in the axial direction is provided in the forward end portion of the main body housing, and a pair of guard ribs rising to a height of 3 mm or more in a direction normal to the direction of passage of the engagement portion are formed at the edge of the rearward end of the engagement portion and at a location retracted 4-9 mm from the edge portion at the rearward end in the axial direction of the main body housing.

* * * * *